US006276783B1

(12) United States Patent
Ishinaga et al.

(10) Patent No.: US 6,276,783 B1
(45) Date of Patent: Aug. 21, 2001

(54) METHOD FOR DISCHARGE OF LIQUID AND LIQUID DISCHARGE HEAD

(75) Inventors: Hiroyuki Ishinaga, Tokyo; Toshio Kashino, Chigasaki; Aya Yoshihira, Yokohama; Kiyomitsu Kudo, Kawasaki; Yoichi Taneya; Satoshi Shimazu, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/089,254

(22) Filed: Jun. 3, 1998

(30) Foreign Application Priority Data

Jun. 6, 1997 (JP) ..... 9-149383

(51) Int. Cl.[7] ..... B41J 2/05
(52) U.S. Cl. ..... 347/65; 347/67
(58) Field of Search ..... 347/63, 65, 67, 347/20

(56) References Cited

U.S. PATENT DOCUMENTS

| | | | | |
|---|---|---|---|---|
| 4,480,259 | | 10/1984 | Kruger et al. | 347/65 |
| 4,723,129 | | 2/1988 | Endo et al. | 347/56 |
| 4,994,825 | | 2/1991 | Saito et al. | 347/63 |
| 5,208,604 | | 5/1993 | Watanabe et al. | 347/47 |
| 5,278,585 | * | 1/1994 | Karz et al. | 347/65 |
| 5,389,957 | | 2/1995 | Kimuar et al. | 347/20 |
| 5,534,898 | | 7/1996 | Kashino et al. | 347/33 |
| 5,589,858 | | 12/1996 | Kadowaki et al. | 347/14 |
| 5,602,576 | | 2/1997 | Murooka et al. | 347/59 |
| 5,821,962 | * | 10/1998 | Kudo et al. | 347/65 |

FOREIGN PATENT DOCUMENTS

| | | | | |
|---|---|---|---|---|
| 721842 | | 7/1996 | (EP) . | |
| 721843 | | 7/1996 | (EP) . | |
| 811492 | * | 6/1997 | (EP) | B41J/2/05 |
| 55-81172 | | 6/1980 | (JP) . | |
| 59-26270 | | 2/1984 | (JP) . | |
| 61-59911 | | 3/1986 | (JP) . | |
| 61-59914 | | 3/1986 | (JP) . | |
| 1-247168 | | 10/1989 | (JP) . | |
| 2-137930 | | 5/1990 | (JP) . | |
| 4-329148 | | 11/1992 | (JP) . | |
| 5-229122 | | 9/1993 | (JP) . | |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head is provided which allows production of a recorded image of improved quality by controlling the speed of flow of a liquid and the distribution of the speed of flow in a flow path caused in consequence of contraction of bubbles thereby stabilizing the direction of satellites arising behind main drops of discharged liquid and, at the same time, decreasing the amount itself of the satellites. This liquid discharge head comprises a movable separation membrane capable of effecting separation between a first flow path communicating with a discharge port for discharging a liquid and a second flow path furnished with a bubble generating region for generating bubbles in the liquid by means of a heating element and a movable member opposed to the bubble generating region across the movable separation membrane and furnished in the direction of liquid discharge with a free end to guide the displacement of the movable separation membrane induced by the growth of the bubbles in the direction of the discharge port and regulate the shape of displacement of the movable separation membrane as well.

75 Claims, 14 Drawing Sheets

METHOD FOR DISCHARGE OF LIQUID AND LIQUID DISCHARGE HEAD

BACKGROUND OF THE INVENTION

1. Field of the Invention

This invention relates to a method for discharge of a liquid wished to be discharged and a liquid discharge head which resort to generation of bubbles by means of thermal energy, for example, and more particularly to a method for the discharge of a liquid and a liquid discharge head which rely on the use of a movable separation membrane capable of effecting displacement of its own in consequence of the generation of bubbles.

The term "record" as used herein means not merely the action of imparting images such as characters and figures which have meanings to a recording medium but also the action of imparting figures such as patterns which are destitute of meaning to the recording medium.

2. Related Background Art

The so-called bubble jet recording medium, i.e. the version of ink jet recording method which effects the formation of an image on a recording medium by exerting the energy of heat, for example, on an ink thereby causing the ink to produce a change of state accompanied by an abrupt volumetric change (generation of bubbles) and thereby enabling the force of action due to this change of state to discharge the ink through a discharge port and allowing the discharged ink to adhere to the recording medium, has been heretofore known to the art. The recording device which utilizes this bubble jet recording method, as disclosed in JP-B-61-59911 and JP-B-61-59914, is generally furnished with a discharge port for allowing the discharge of ink, an ink flow path communicating with the discharge port, and a heating element (electrothermal converting element) disposed in the ink flow path and adapted as an energy generating means for effecting the discharge of ink.

The recording method described above enjoys many fine features such as permitting easy production of recorded images and further color images of high resolution by the use of a small device because this recording method enables images of high quality to be recorded at high speed with low noise and the head embodying this recording method permits discharge ports for the discharge of this ink to be disposed in high density. The bubble jet recording method, therefore, has come to be utilized in recent years in numerous office devices such as printers, copying devices, and facsimile devices. It is now on the verge of finding utility in industrial applications such as for a printing device.

In the conventional bubble jet recording method, since the heating element held in contact with the ink repeats application of heat to the ink, it has the possibility of scorching the ink and forming on the surface thereof a deposit of scorched ink. When the liquid wished to be discharged is apt to be deteriorated by heat or it is not easily allowed to bubble generating sufficiently, there are times when the formation of bubbles by direct heating with the heating element mentioned above will fail to bring about perfect discharge of the liquid.

The present applicant has proposed in JP-A-55-81172 a method for effecting discharge of a discharging liquid by bubble generating the bubbling liquid with a thermal energy applied thereto through the medium of a flexible membrane adapted to separate the bubbling liquid and the discharging liquid. This method is constructed such that the flexible membrane and the bubbling liquid are disposed in part of a nozzle. In contrast, a construction using a large membrane capable of separating the head in its entirety into an upper and a lower part is disclosed in JP-A-59-26270. This large membrane is aimed at enabling a liquid flow path to be interposed between two plate members and consequently preventing liquids held back by the two plate members from mingling with each other.

As ideas that take consideration of bubble generating properties which are characteristic of bubbling liquids themselves, an invention of JP-A-05-229122 which uses a liquid having a lower boiling point than a discharging liquid and an invention of JP-A-04-329148 which uses an electroconductive liquid as a bubbling liquid have been also known to the art.

The conventional method for discharge of liquid by the use of a separation membrane has not reached a level of feasibility because it is constructed solely for the separation of a bubbling liquid and a discharging liquid or is intended only for improving the bubbling liquid itself.

The present inventors have pursued a study on the discharge of liquid drops by the use of a separator, with emphasis on the liquid drops subjected to discharging, and have consequently reached a conclusion that the discharge of liquid brought about by the formation of bubbles with the thermal energy has the efficiency thereof degraded through the intervention of the aging of the separation membrane and has not yet been reduced to practice.

The present inventors, therefore, have initiated a study in search of a method for discharge of liquid and a device therefor which can utilize the effect the function of separation by the separation membrane and meanwhile exalt the discharge of liquid to a higher level. The present invention has originated in the course of this study and is directed to providing an epochal method of discharge and a device therefor which can improve the efficiency of discharge of liquid drops and can stabilize and exalt the volume of liquid drops to be discharged and the speed of discharge of liquid drops. Specifically, this invention resides in a liquid charge head furnished with a first flow path used for a discharging liquid and adapted to communicate with a discharge port, a second flow path adapted to supply or transfer a bubbling liquid and embrace a bubble generating region, and a movable separation membrane for separating the first and the second flow path, which features the ability to improve the efficiency of discharge.

The present inventors, particularly concerning the liquid discharge head disclosed in JP-A-05-229122, have demonstrated that a small empty space destined to serve as a bubble generating region is disposed on the upstream side of a discharge port relative to the direction of the flow of a discharging liquid, that the bubble generating region itself barely has the same width and length as a heating element, that when the bubble generating region emits bubbles, a flexible membrane is displaced by the generation of the bubbles only in the vertical direction relative to the direction of discharge of the discharging liquid, and that the liquid discharge head consequently entails the problem of producing no sufficient discharging speed and performing no efficient discharging motion. The inventors, regarding the cause for this problem, have taken notice of the fact that the same bubbling liquid always uses repeatedly the closed small empty space and have ultimately realized the production of an efficient discharging motion by virtue of the present invention.

The present invention has been produced in the light of the problem encountered by the prior art as mentioned above. The first object of this invention is to provide, in a construction for substantially separating, preferably perfectly separating, a discharging liquid and a bubbling liquid by means of a movable separation membrane, a method for the discharge of liquid and a liquid discharge head which, while the force generated by the pressure of bubbles is deforming the movable separation membrane and transferring the pressure to the discharging liquid, not only prevent the pressure from escaping toward the upstream side but also guide the pressure in the direction of the discharge port and give rise to a high discharging force without a sacrifice of the efficiency of discharging.

The second object of this invention is to provide a method for the discharge of liquid and a liquid discharge head which, owing to the construction described above, allow a decrease in the amount of a deposit suffered to pile on a heating element and permit efficient discharge of liquid without inflicting a thermal effect on the discharging liquid.

The third object of this invention is to provide a method for the discharge of liquid and a liquid discharge head which enjoy broad freedom of selection without reference to the viscosity of the discharging liquid or the composition of the material thereof.

Specifically, the major object of this invention resides in providing a liquid discharge head which, besides fulfilling the objects mentioned above, allows control of the speed of the flow of liquid in the flow path communicating with the discharge port in consequence of the contraction of bubbles and the distribution of speed, stabilizes the direction of flow of the satellites arising behind the main liquid drops discharged, and exalts the quality of a recorded image by decreasing the amount itself of the satellites. It also resides in providing a liquid discharge head which decreases the amount of retraction of a meniscus of the liquid, improves the refill property, and copes with a high-frequency oscillation.

SUMMARY OF THE INVENTION

The means which the present invention adopts for fulfilling the objects mentioned above will be described below.

The method for the discharge of a liquid according to this invention comprises a step of effecting the discharge of the liquid aimed at by causing a movable separation membrane which constantly keeps in a substantially separated state a first flow path adapted to discharge a liquid and communicate with a discharge port and a second flow path provided with a bubble generating region for generating bubbles in the liquid to be displaced with the bubbles mentioned above more on the downstream side than on the upstream side within the range of displacement of the movable separation membrane and discharges the liquid via the discharge port by virtue of the displacement of the movable separation membrane with bubbles, which method is characterized by incorporating a step of repressing the retraction of a meniscus of liquid via the discharge port into the first flow path by regulating the return speed (VB) of the movable separation membrane on the upstream side to a level higher than the return speed (VB) of the movable separation membrane on the downstream side by the use of a movable member adapted to move in concert with the range of displacement of the movable separation membrane during the return of the movable separation membrane toward the second flow path in consequence of the contraction of the bubbles and provided on the discharge port side with a free end.

This invention is further directed to a method for the discharge of a liquid, comprising a step of effecting the discharge of the liquid aimed at by causing a movable separation membrane which constantly keeps in a substantially separated state a first flow path adapted to discharge a liquid and communicate with a discharge port and a second flow path provided with a bubble generating region for generating bubbles in the liquid to be displaced with the bubbles mentioned above more on the downstream side than on the upstream side within the range of displacement of the movable separation membrane and discharges the liquid via the discharge port by virtue of the displacement of the movable separation membrane with bubbles, which method is characterized by forming a distribution of meniscus retraction substantially symmetrized relative to the central line of the discharge port by regulating the return of the movable separation membrane toward the second flow path in consequence of the contraction of the bubbles by the use of a movable member adapted to move in concert with the range of displacement of the movable separation membrane during the return of the movable separation membrane toward the second flow path in consequence of the contraction of the bubbles and provided on the discharge port side with a free end.

This invention is further directed to a method for the discharge of a liquid, comprising a step of effecting the discharge of the liquid aimed at by causing a movable separation membrane which constantly keeps in a substantially separated state a first flow path adapted to discharge a liquid and communicate with a discharge port and a second flow path provided with a bubble generating region for generating bubbles in the liquid to be displaced with the bubbles mentioned above more on the downstream side than on the upstream side within the range of displacement of the movable separation membrane and discharges the liquid via the discharge port by virtue of the displacement of the movable separation membrane with bubbles, which method is characterized by forming a distribution of meniscus retraction substantially symmetrized relative to the central line of the discharge port by allowing the presence of at least part of the displacement region of the movable separation membrane in the initial state in a substantially projected region of the discharge port along the central line of the discharge port during the return of the movable separation membrane toward the second flow path in consequence of the contraction of the bubbles.

As an apparatus for specifically implementing the step of displacement which characterizes the present invention as described above, the structure to be described below may be cited. In addition thereto, other structures which are covered by the technical idea of this invention and which are capable of accomplishing the step of displacement are embraced by this invention.

The term "regulation of direction" mentioned herein below embraces the structure of the movable separation member itself (such as, for example, the distribution of elasticity and the combination of the deforming elongated part and the nondeformed part), the additive members acting on the movable separation membrane or on the structure of the first flow path, and the combinations thereof.

The term "displacement region" or "movable region" of the movable separation membrane to be mentioned herein below embraces the region of displacement and the region in which the displacement is allowed.

A typical liquid discharge head according to this invention comprises a first flow path communicating with a discharge port for discharging a liquid, a second flow path provided with a bubble generating region for generating bubbles by operating an energy generating element on a liquid, and a movable separation membrane for substantially separating the first flow path and the second flow path from each other and effects the discharge of the liquid by causing displacement with the bubbles on the upstream side from the discharge port relative to the flow of the liquid in the first flow path, which liquid discharge head is characterized by being provided with a direction regulating device for regulating the direction of the movable separation membrane during the displacement of the movable separation membrane toward the second flow path in consequence of the contraction of the bubbles.

The liquid discharge head is further characterized by the fact that the direction regulating device is a movable member opposed to the bubble generating region across the movable membrane and provided in the direction of the discharge port with a free end and the movable member and the movable separation membrane are joined at least in part to each other.

The liquid discharge head of this invention is further characterized by the fact that a heating element for emitting the heat for the generation of bubbles mentioned above is provided at a position at which the bubble generating region is opposed to the movable member.

The liquid discharge head of this invention is further characterized by the fact that the downstream part of the bubbles generated in the bubble generating region comprises the bubbles which are generated on the downstream side from the center of the area of the heating element mentioned above.

The liquid discharge head of this invention is further characterized by the fact that the movable member mentioned above has the free end thereof mentioned above positioned on the discharge port side from the center of the area of the heating element.

The liquid discharge head of this invention is further characterized by the fact that the movable member mentioned above is shaped like a plate.

The liquid discharge head of this invention is further characterized by the fact that the movable separation membrane is formed of a resin.

The liquid discharge head of this invention is further characterized by being provided with a first common liquid chamber for storing a liquid to be fed to the first flow path and a second common liquid chamber for storing a liquid for to be fed to the second flow path.

The liquid discharge head of this invention is further characterized by the fact that the liquid to be fed to the first flow path and the liquid to be fed to the second flow path are different liquids.

The liquid discharge head of this invention is further characterized by the fact that the liquid to be fed to the second flow path excels the liquid to be fed to the first flow path in at least one of the properties, i.e. lowness of viscosity, bubble generating property, and thermal stability.

The liquid discharge head of this invention is further characterized by the fact that the leading terminal part of the movable separation membrane is disposed so that the extension thereof is positioned above the lower part of the discharge port and separated from the orifice plate having the discharge port formed therein.

The liquid discharge head of this invention is further characterized by the fact that a lower displacement regulating part allowing the movable member to have a width greater than the width of the second flow path is disposed near the free end of the movable member.

The liquid discharge head of this invention is further characterized by the fact that the movable separation membrane is furnished with a slack part.

Since this invention is constructed as described above, the movable separation membrane disposed on the bubble generating region is expanded by the pressure produced by the generation of bubbles and the movable member disposed on the movable separation membrane is displaced toward the first flow path and the movable separation membrane is expanded by the pressure mentioned above in the direction of the discharge port on the first flow path side. As a result, the liquid is efficiently discharged with high discharging force through the discharge port.

When the movable separation membrane is provided in the deformation region thereof with a slack part, the liquid discharge head is allowed to acquire a greater discharging force more efficiently because the volume of the bubbles acts more effectively on the deformation of the movable separation membrane owing to the pressure generated by the bubbles and because the movable member displaces more largely toward the first flow path and the movable separation membrane expands in the direction of discharge while shifting in the direction of discharge port.

Since the movable separation membrane so elongated is returned quickly to the home position by the resilient force owned by the movable member in addition to the pressure arising from the contraction of bubbles, the control of the pressure in the acting direction thereof is improved and the speed at which the first flow path is refilled with the discharging liquid is heightened, the discharge of liquid is stably attained even during the printing at a high speed.

Further, the amount of satellite discharged can be decreased and the quality of an image printed can be improved by attaching the movable member to the movable separation membrane and heightening the speed of return by the resiliency of the movable member.

Since the shape of deformation of the movable separation membrane can be regulated by the action of the movable member, the quality of an image can be improved by uniformizing the distribution of the flow rate of the liquid in the flow path during the retraction of the meniscus, uniformizing the shape of the meniscus, and stabilizing the direction of the flow of satellites.

BRIEF DESCRIPTION OF THE DRAWINGS

FIG. 6A representing a head furnished with a protective membrane and FIG. 6B representing a head devoid a protective membrane.

DESCRIPTION OF THE PREFERRED EMBODIMENTS

Figure 1A:
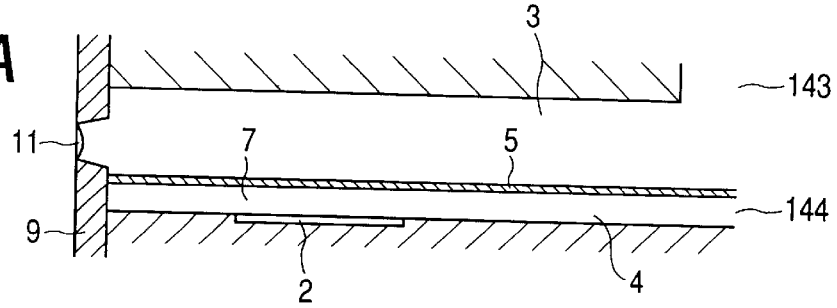
FIGS. 1A, 1B, 1C, 1D and 1E are cross sections of the directions of flow path depicted to aid in the description of the first example of the method for liquid discharge applicable to the present invention.

The modes of embodying the present invention will be described below with reference to the accompanying drawings.

[Examples applicable to Embodiment of the Invention]

Now, two examples which are applicable to the embodiment of the present invention will be described.

FIGS. 1A to 1E, 2A to 2E and 3A to 3C are diagrams depicted to aid in the description of examples of the method for discharge of liquid which are applicable to the present invention. A discharge port is disposed in the terminal area of a first flow path. On the upstream side of the discharge port (relative to the direction of flow of a discharging liquid in the first flow path), the displacing region of a movable separation membrane capable of being displaced in accordance as the bubbles generated are grown. A second flow path is adapted to store a bubbling liquid or is filled with the bubbling liquid (preferably adapted to permit refill or allow the bubbling liquid to produce a motion) and is furnished with a bubble generating region.

In this example, the bubble generating region is located on the upstream area from the discharge port side relative to the direction of flow of the discharging liquid mentioned above. Moreover, the separation membrane is allowed to have a greater length than an electrothermal conversion element forming the bubble generating region and is consequently endowed with a movable region. A stationary part (not shown) is provided between the upstream side terminal part of the electrothermal conversion element and the common liquid chamber of the first flow path relative to the direction of flow mentioned above, preferably in the upstream side terminal part mentioned above. The range in which the separation membrane is allowed substantial movement, therefore, ought to be understood from FIGS. 1A to 1E, 2A to 2E and 3A to 3C.

The state of the movable separation membrane depicted in these diagrams represents all the elements such as the elasticity and thickness of the movable separation membrane itself or the factors derivable from other additional structures.

(First example)

FIGS. 1A to 1E comprise cross sections of directions of flow path depicted to aid in the description of the first example of the method of liquid discharge applicable to this invention (wherein the step of displacement contemplated by this invention initiates halfway along the length of the step of liquid discharge).

In this example as illustrated in FIGS. 1A to 1E, a first flow path 3 which directly communicates with a discharge port 11 is filled with the first liquid which is supplied from a common liquid chamber 143 and a second flow path 4 provided with a bubble generating region 7 is filled with a bubbling liquid which generates a bubble upon application of a thermal energy given by a heating element 2. A movable separation membrane 5 for separating the first flow path 3 and the second flow path 4 from each other is disposed between the first flow path 3 and the second flow path 4. The movable separation membrane 5 and an orifice plate 9 are tightly fixed to each other and they do not suffer the liquids in the two flow paths to mingle with each other.

The movable separation membrane 5 generally manifests no directional property while it is being displaced by the bubbles generated in the bubble generating region 7. Rather, there are times when this displacement possibly proceeds toward the common liquid chamber side which enjoys high freedom of displacement.

This example, which has stemmed from the particular notice directed to this motion of the movable separation membrane 5, contemplates providing a device for controlling the direction of the displacement which directly or indirectly acts on the movable separation membrane 5 itself. This device is adapted to cause the displacement (motion, expansion, elongation, etc.) produced in the movable separation membrane 5 by the bubbles to proceed in the direction of the discharge port.

In the initial state illustrated in FIG. 1A, the liquid in the first flow path 3 is drawn in closely to the discharge port 11 by the capillary force. In the present example, the discharge port 11 is located on the downstream side relative to the direction of flow of the liquid in the first flow path 3 with respect to the area in which the heating element 2 is projected to the first flow path 3.

Figure 1B:
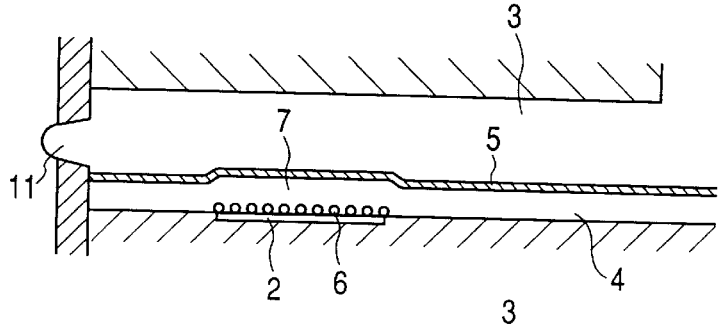

In the existing state, when the thermal energy is applied to the heating element 2 (a heating resistor measuring 40 $\mu$m×105 $\mu$m, in the present mode), the heating element 2 is quickly heated and the surface of the bubble generating region 7 contacting the second liquid causes the second liquid to be bubbled by the heat (FIG. 1B). The bubbles 6 thus generated by the heating are based on such a phenomenon of membrane boiling as is disclosed in U.S. Pat. No. 4,723,129. They are generated as accompanied by extremely high pressure all at once throughout the entire surface of the heating element. The pressure generated at this time propagates in the form of pressure wave through the second liquid in the second flow path 4 and acts on the movable separation membrane 5, with the result that the movable separation membrane 5 will be displaced and the discharge of the first liquid in the first flow path 3 will be started.

Figure 1C:
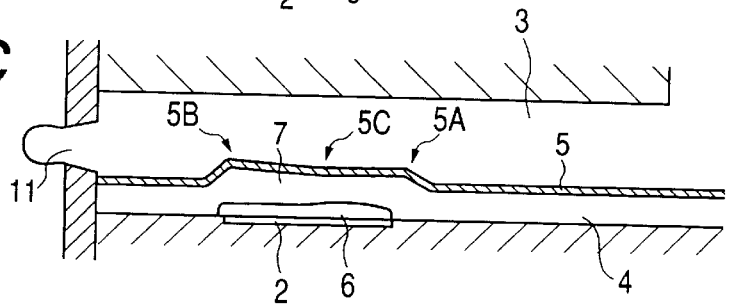

As the bubbles 6 generated on the entire surface of the heating element 2 grow quickly, they assume the shape of a membrane (FIG. 1C). The expansion of the bubbles 6 by the very high pressure in the nascent state further adds to the displacement of the movable separation membrane 5 and, as a result, promotes the discharge of the first liquid in the first flow path 3 through the discharge port 11.

Figure 1D:
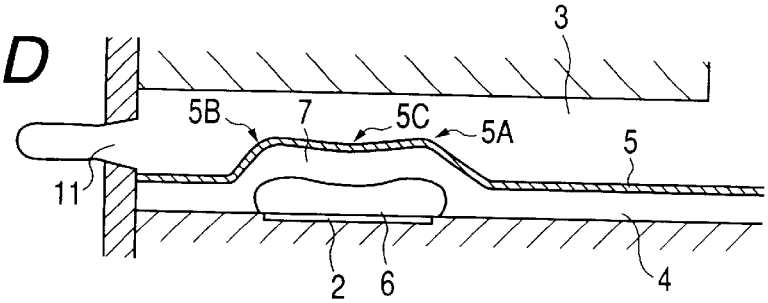

When the growth of the bubbles 6 further continues, the displacement of the movable separation membrane 5 gains in volume (FIG. 1D). Until the state illustrated in FIG. 1D arises, the movable separation membrane 5 continues its elongation such that the displacement of the upstream side part 5A thereof and that of the downstream side part 5B thereof are substantially equal relative to the central part 5C of the region of the movable separation membrane 5 opposite the heating element 2.

Figure 1E:
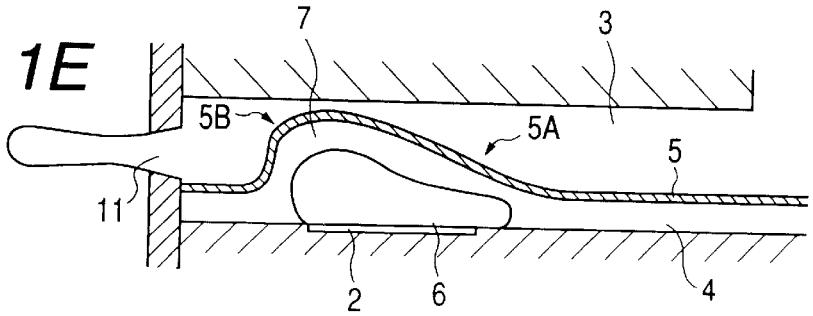

As the bubbles 6 further grow thereafter, the bubbles 6 and the movable separation membrane 5 continuing its displacement are severally displaced in the direction of the discharge output rather more on the upstream side part 5A than on the downstream side part 5B and, as a result, the first liquid in the first flow path 3 is directly moved in the direction of the discharge output 11 (FIG. 1E).

The efficiency of discharge is further improved owing to the incorporation of the step for effecting the displacement of the movable separation membrane 5 in the direction of discharge on the downstream side so as to allow direct motion of the liquid in the direction of the discharge port as described above. The fact that the motion of the liquid toward the upstream side is decreased relatively brings about a favorable effect on the refill of the liquid (replenished from the upstream side) in the nozzle, specifically the displacing region of the movable separation membrane 5.

When the movable separation membrane 5 itself is displaced in the direction of the discharge port so as to induce a change of state from FIG. 1D to FIG. 1E as illustrated in the respective diagrams FIG. 1D and FIG. 1E, the efficiency of discharge and the efficiency of refill mentioned above can be further improved and, at the same time, the amount of discharge can be exalted by inducing transfer of the portion of the first liquid in the region of projection of the heating element 2 in the first flow path 3.

(Second example)

FIGS. 2A to 2E are cross sections of the direction of flow path depicted to aid in the description of the second example of the method for discharge of liquid which are applicable to the present invention (wherein the step of displacement contemplated by this invention starts from the initial stage).

This example is basically identical in structure to the first example described above. A first flow path 13 which directly communicates with the discharge port 11 is filled with the first liquid supplied from the first common liquid chamber 143 and a second flow path 14 furnished with a bubble generating region 17 is filled with a bubbling liquid which emits bubbles on exposure to a thermal energy supplied by a heating element 12. A movable separation membrane 15 adapted to separate the first flow path 13 and the second flow path 14 from each other is interposed between the first flow path 13 and the second flow path 14. The movable separation membrane 15 and an orifice plate 19 are tightly fixed to each other and they do not suffer the liquids in the two flow paths to mingle with each other.

Figure 2A:
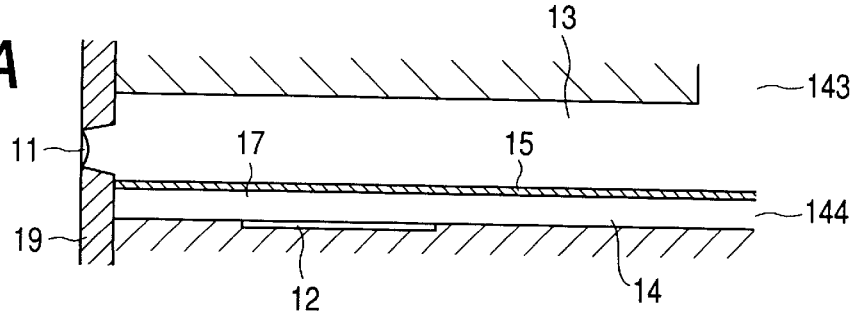
FIGS. 2A, 2B, 2C, 2D and 2E are cross sections of the direction of flow path depicted to aid in the description of the second example of the method for liquid discharge applicable to the present invention.

In the initial state illustrated in FIG. 2A, similarly in FIG. 1A, the liquid in the first flow path 13 is drawn in closely to the discharge port 11 by the capillary force. In the present example, the discharge port 11 is located on the downstream side relative to the area in which the heating element 12 is projected to the first flow path 13.

Figure 2B:
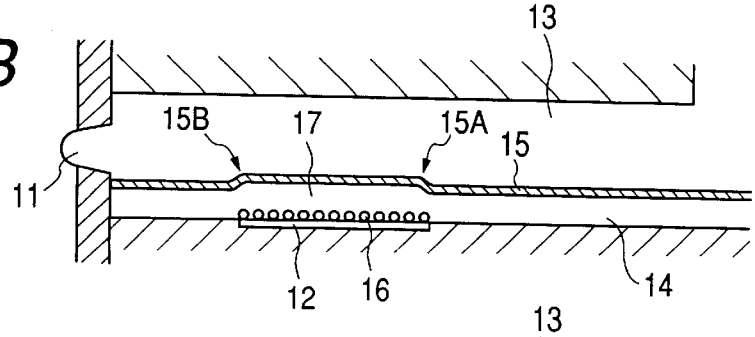

In the existing state, when the thermal energy is given to the heating element 12 (a heating resistor measuring 40 $\mu$m×115 $\mu$m, in the present mode), the heating element 12 is quickly heated and the surface of the bubble generating region 17 contacting the second liquid causes the second liquid to be bubbled by the heat (FIG. 2B). The bubbles 16 thus generated by the heating are based on such a phenomenon of membrane boiling as is disclosed in U.S. Pat. No. 4,723,129. They are generated as accompanied by extremely high pressure all at once throughout the entire surface of the heating element. The pressure generated at this time propagates in the form of pressure wave through the second liquid in the second flow path 14 and acts on the movable separation membrane 15, with the result that the movable separation membrane 15 will be displaced and the discharge of the first liquid in the first flow path 13 will be started.

Figure 2C:
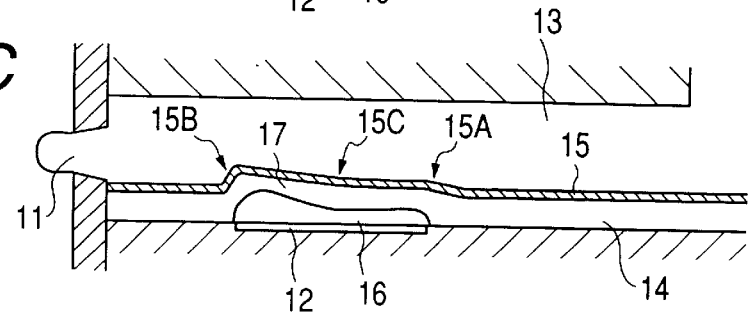
Figure 2D:
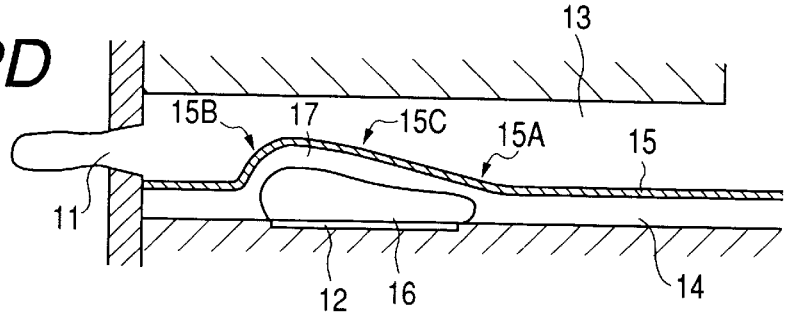

As the bubbles 16 generated on the entire surface of the heating element 12 grow quickly, they eventually assume the shape of a membrane (FIG. 2C). The expansion of the bubbles 16 by the very high pressure in the nascent state further adds to the displacement of the movable separation membrane 15 and, as a result, promotes the discharge of the first liquid in the first flow path 13 through the discharge port 11. At this time, the movable separation membrane 15 has the downstream side part 15B of the movable region thereof displaced rather more than the upstream side part 15A thereof from the initial stage as illustrated in FIG. 2C. The first liquid in the first flow path 13, therefore, is moved to the discharge port 11 with high efficiency from the initial stage.

When the growth of the bubbles 16 further advances thereafter, the displacement of the movable separation membrane 15 is proportionately enlarged (FIG. 2D) because the displacement of the movable separation membrane 15 and the growth of the bubbles are promoted relative to the state illustrated in FIG. 2C. Particularly, since the downstream side part 15B of the movable region is displaced more largely in the direction of the discharge port than the upstream side part 15A and the central part 15C, the first liquid in the first flow path 13 directly moves with acceleration in the direction of the discharge port. Since the displacement of the upstream side part 15A is small throughout the entire process, the motion of the liquid in the upstream direction is diminished.

The method of liquid discharge in this example, therefore, can improve the discharge efficiency, especially the discharge speed and further can favorably stabilize the refill of the liquid in the nozzle and the volume of the discharged liquid drops.

Figure 2E:
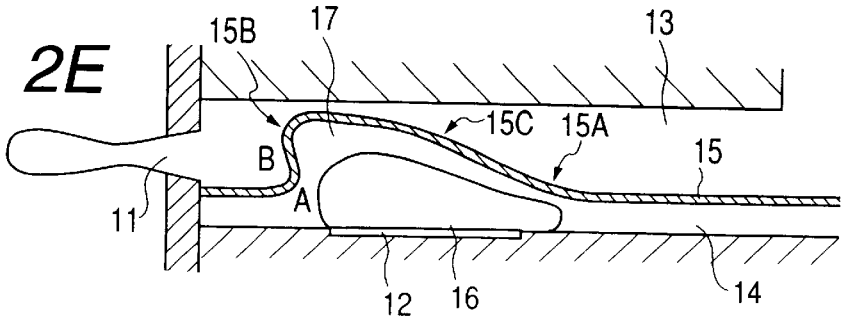

When the growth of the bubbles 16 further continues thereafter, the downstream side part 15B and the central part 15C of the movable separation membrane 15 are further displaced and elongated in the direction of the discharge port to promote the effect mentioned above, namely the improvement of the discharge efficiency and the discharge speed (FIG. 2E). Particularly, since the shape of the movable separation membrane 15 in this case is enlarged not only in the cross section but also in the sizes of displacement and elongation in the direction of width of the flow path, the operating region for moving the first liquid in the first flow path 13 is increased and the discharge efficiency is synergistically improved. Since the shape of the displacement of the movable separation membrane 15 at this time resembles the shape of a human nose, it will be particularly referred to as "nose shape". The nose shape is to be construed as embracing the shape of the latter "S" in which the point B located on the upstream side in the initial state assumes a position on the downstream side from the point A located on the downstream side in the initial state as illustrated in FIG. 2E and the shape in which the points A and B assume equivalent positions as illustrated in FIG. 1E.

(Example of Displacement applicable to Movable Separation Membrane)

Figure 3A:
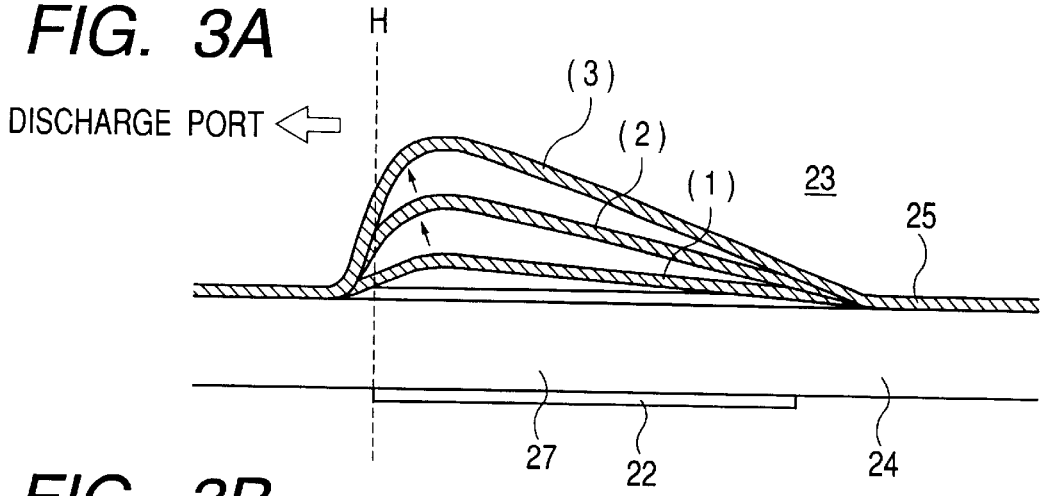
FIGS. 3A, 3B and 3C are cross sections of the direction of flow path depicted to aid in the description of the step of displacement of a movable separation membrane in the method for liquid discharge applicable to the present invention.
Figure 3B:
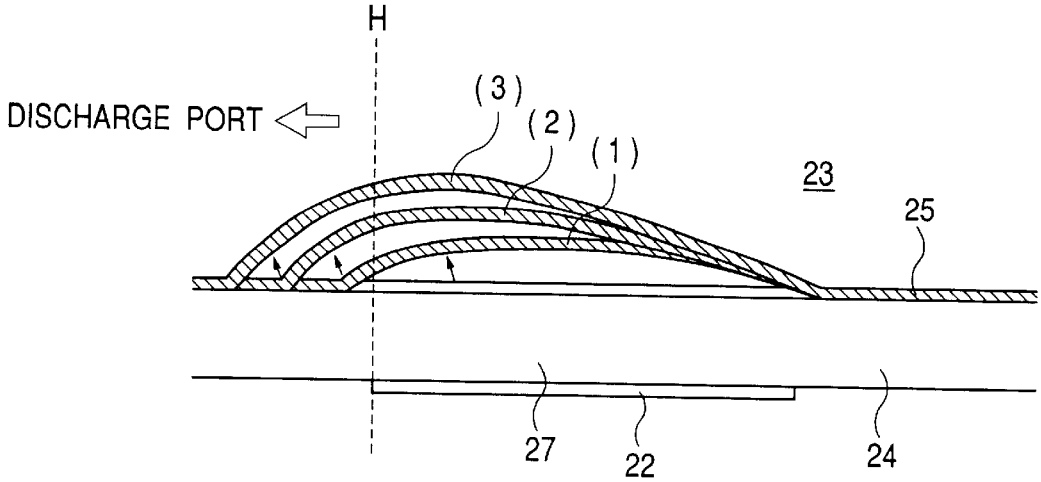
Figure 3C:
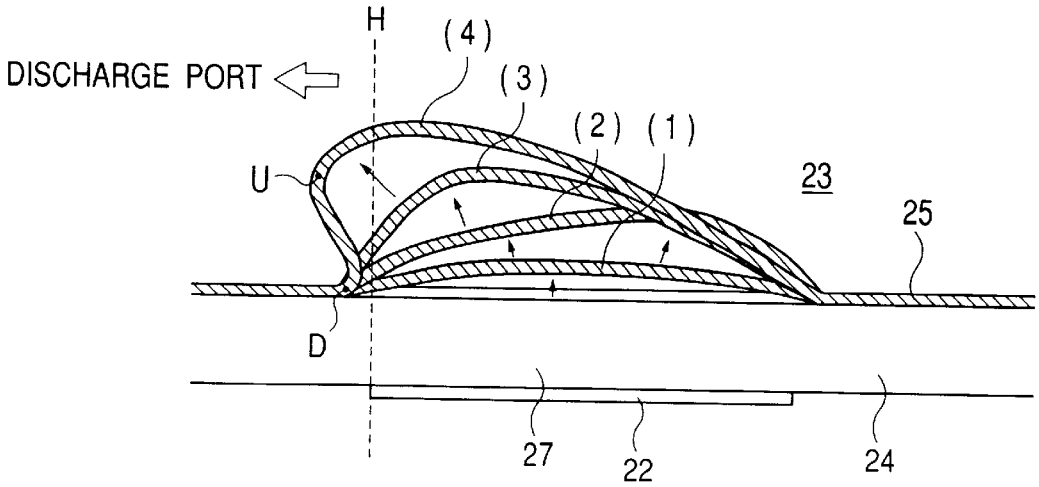

FIGS. 3A to 3C are cross sections of a direction of flow path depicted to aid in the description of the step of displacement of the movable separation membrane in the method of liquid discharge according to this invention.

This example is intended to center its description specifically on the range of motion of the movable separation membrane and the change in displacement thereof, it will omit illustrating the bubbles, first flow path, and discharge port. All the relevant diagrams, as a basic structure, presume that the portion of a second flow path 24 which approximates closely to the region of projection of a heating element 22 constitutes itself a bubble generating region 27 and the second flow path 24 and a first flow path 23 are substantially separated by a movable separation membrane 25 constantly, i.e., from the initial stage through the duration of displacement. A discharge port is disposed on the downstream side and a part for feeding the first liquid on the upstream side with the downstream side terminal part (line H in the diagram) of the heating element 22 as the border line. The terms "upstream side" and "downstream side" as used in the present and following examples are meant in relation to the direction of flow of the liquid in the relevant flow path as viewed from the central part of the movable range of the movable separation membrane.

The method using the structure illustrated in FIG. 3A incorporates therein from the initial stage a step of displacing a movable separation membrane 25 from the initial state sequentially in the order of (1), (2), and (3) and more largely on the downstream side than the upstream side and particularly succeeds in improving the discharge speed because it operates to exalt the discharge efficiency and, at the same time, enable the displacement on the downstream side to impart to the first liquid in the first flow path 23 such a motion as to be forced out in the direction of the discharge port. In the structure of FIG. 3A, the movable range mentioned above is assumed to be substantially fixed.

In the structure illustrated in FIG. 3B, the movable range of the movable separation membrane 25 is shifted or enlarged toward the discharge port in accordance as the movable separation membrane 25 is displaced sequentially in the order of (1), (2), and (3) in the diagram. In the ensuant form, the movable range mentioned above has the upstream side thereof fixed. The discharge efficiency can be further exalted here because the movable separation membrane 25 is displaced more largely on the downstream side than on the upstream side thereof and because the bubbles are grown in the direction of the discharge port.

In the structure illustrated in FIG. 3C, while the movable separation membrane 25 changes from the initial state (1) to the state shown in (2) in the diagram, the upstream side and the downstream side are evenly displaced or the upstream side is displaced rather more largely than the downstream side. As the bubbles further grow from (3) to (4) in the diagram, the downstream side is displaced more largely than the upstream side. As a result, even the first liquid in the upper part of the movable region can be moved in the direction of the discharging port, the discharge efficiency can be improved, and at the same time, the amount of discharge can be increased.

Further, at the step illustrated in (4) of FIG. 3C, since a certain point U of the movable separation membrane 25 is displaced more toward the discharge port than the point D located on the downstream than the point U in the initial state, the discharge efficiency can be further exalted by the part thrust out toward the discharge port in consequence of the expansion. The state consequently assumed will be referred to as "nose shape" as mentioned above.

The methods of liquid discharge which incorporate therein such steps as described above are applicable to the present invention. The components illustrated in FIGS. 3A to 3C do not always function independently of each other. The steps which incorporate such components therein are likewise applicable to this invention. The step which involves the formation of the nose shape is not limited to the structure illustrated in FIG. 3C. It can be incorporated in the structures illustrated in FIGS. 3A and 3B. For the movable separation membrane used in the structure of FIGS. 3A to 3C, the possession of expansibility does not matter and the preparatory impartation of slackness suffices. The thickness of the movable separation membrane appearing in the diagram has no dimensional significance.

The expression "device for controlling direction" as used in the present specification applies to at least one of all the members (means) which bring about the "displacement" specified by the present invention, such as, for example, those stemming from the structure or characteristic of the movable separation membrane itself, those pertaining to the operation or disposition of the bubble generating device with respect to the movable separation membrane, those relating to the fluid resistance offered by the vicinity of the bubble generating region, those acting directly or indirectly on the movable separation membrane, or those effecting control of the displacement or elongation of the movable separation membrane. The embodiments incorporating a plurality (two or more) of such direction controlling devices as mentioned above, therefore, are naturally embraced by the present invention. The examples which will be cited herein below make no definite mention of arbitrary combination of a plurality of direction-controlling devices. This notwithstanding, the present invention does not need to be limited to the following examples.

(Mode of First Embodiment)

EXAMPLE 1

Figure 4A:
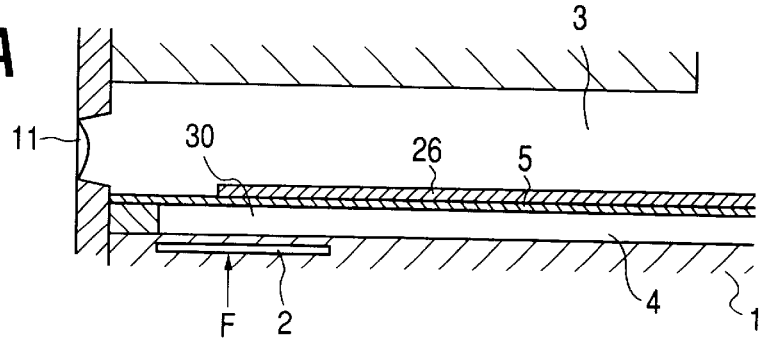
FIGS. 4A, 4B, 4C and 4D are model diagrams of cross section of direction of flow path for illustrating the first example of the liquid discharge head of the present invention.
Figure 4B:
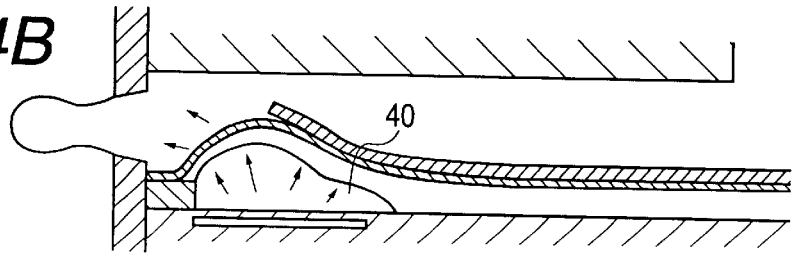
Figure 4C:
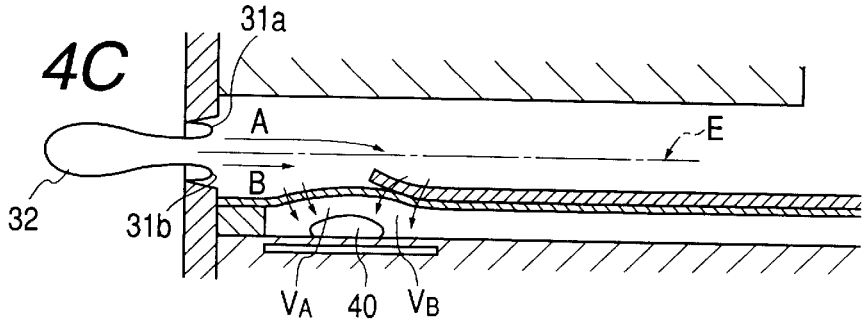
Figure 4D:
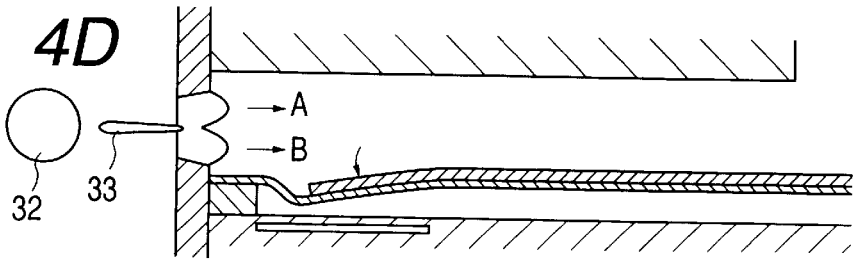

FIGS. 4A to 4D are model diagrams of the cross section of direction of a flow path for illustrating the first example of the liquid discharge head of the present invention;

FIG. 4A representing the state of the liquid discharge head during the absence of liquid discharge, FIG. 4B representing the state of bubbles 40 grown to the largest volume, FIG. 4C representing the state of bubbles in the process of contraction, and FIG. 4D representing the state of bubbles after substantial distinction.

The present liquid discharge head causes generation of bubbles in a bubble generating region 30 of the second flow path 4 near the heating element 2 (40×105 $\mu$m, for example) because this heating element 2 which is disposed on the device substrate 1 heats the liquid in the bubble generating region 30 and induces membrane boiling as illustrated in FIG. 4A.

This region and the first flow path 3 communicating with the discharge port 11 are substantially separated from each other by the movable separation membrane 5 and, consequently, the liquid of the first flow path 3 and that of the second flow path 4 are not suffered to mingle with each other. These liquids of the first and the second flow path 3 and 4 may be the same or different, depending on the purpose of use.

Further, in the case of this invention, a movable member 26 having a free end provided on the discharge port side is disposed opposite the displacement region of the movable separation membrane 5 which is displaced by the bubbles generated in the bubble generating region 30. The free end is preferred to be positioned on the discharge port side from the center F of the area of the heating element 2 for the sake of the movable member 26 itself.

It is noted from FIG. 4B that the bubble 40 generated by the heating element 2 has grown to the substantially largest volume but the displacement region of the movable separation membrane 5 as a whole has displaced and elongated toward the discharge port because the directions of displacement and elongation of the movable separation membrane 5 are regulated by the movable member 26. Particularly, the displacement and elongation toward the discharge port is accomplished more effectively because the free end of the movable member 26 is disposed on the discharge port side from the center F of the area of the heating element 2 as described above and the displacement region of the movable separation membrane 5 can be regulated substantially wholly.

With reference to FIG. 4C, though the bubbles 40 are in the process of contraction, main drops (liquid drops) 32 separate more quickly from the liquid in the flow path 3 because the movable member 26, by virtue of the resiliency thereof, functions so as to accelerate the contraction of the movable separation membrane 5 and tends to draw meniscuses 31*a* and 31*b* quickly through the discharge port 11 into the flow path 3. As a result, satellites 33 illustrated in FIG. 4D are compelled to lose length and volume as well. The produced images, therefore, contain such satellite only sparingly and enjoy both sharpness and quality. Further, since the ink contains mist only sparingly, it scarcely smears the face and the interior of the printer and adds markedly to the reliability of printing.

With reference to FIG. 4C, the flow speed of liquid within the first flow path 3 during the attraction of the meniscuses 31*a* and 31*b* varies with place. Particularly, between the nearer side 31*b* to and the farther side 31*a* from the movable separation membrane 5 across the center line E of the discharge port 11, the flow speed is possibly higher on the nearer side 31*b* which has small resistance to flow.

The balance of shape between the meniscuses 31*a* and 31*b* affects the direction of the satellites 33. When this balance is notably swayed, the tilt manifests itself as a deviation of the accuracy of impingement of liquid drops on a recording medium. The lost balance also causes a deviation of impingement due to the difference of direction of the discharge of the main drops 32 and the satellites 33. The consequence is a so-called satellite print which impairs the quality of image.

By causing tight union between the movable member 26 and adhere fast to the movable separation membrane 5, however, the speed of contraction of the movable separation membrane 5 is heightened by the resiliency on the opposite side than on the discharge port side, namely the contraction speed $V_A$ of the movable separation membrane 5 on the upstream side (the side opposite the discharge port) of the movable region is heightened than the contraction speed $V_B$ thereof on the downstream side (the discharge port side) to satisfy the relation, $V_B \leqq V_A$, with the result that the flow speed B on the side nearer to the movable separation membrane 5 will be restrained from increasing excessively, the flow speed A on the side offering greater resistance to flow will be heightened, and the simultaneous control of the two flow speeds A and B will be realized. The meniscuses 31*a* and 31*b*, therefore, are symmetralized in shape relative to the center line E of the nozzle and the direction of the satellites 33 is equalized to that of the main drops 32.

Further, the efficiency of supply of liquid from the upstream side can be exalted, the refill property improved, and the drive speed increased by heightening the speed of contraction of the movable separation membrane 5 on the upstream side.

Figure 5:
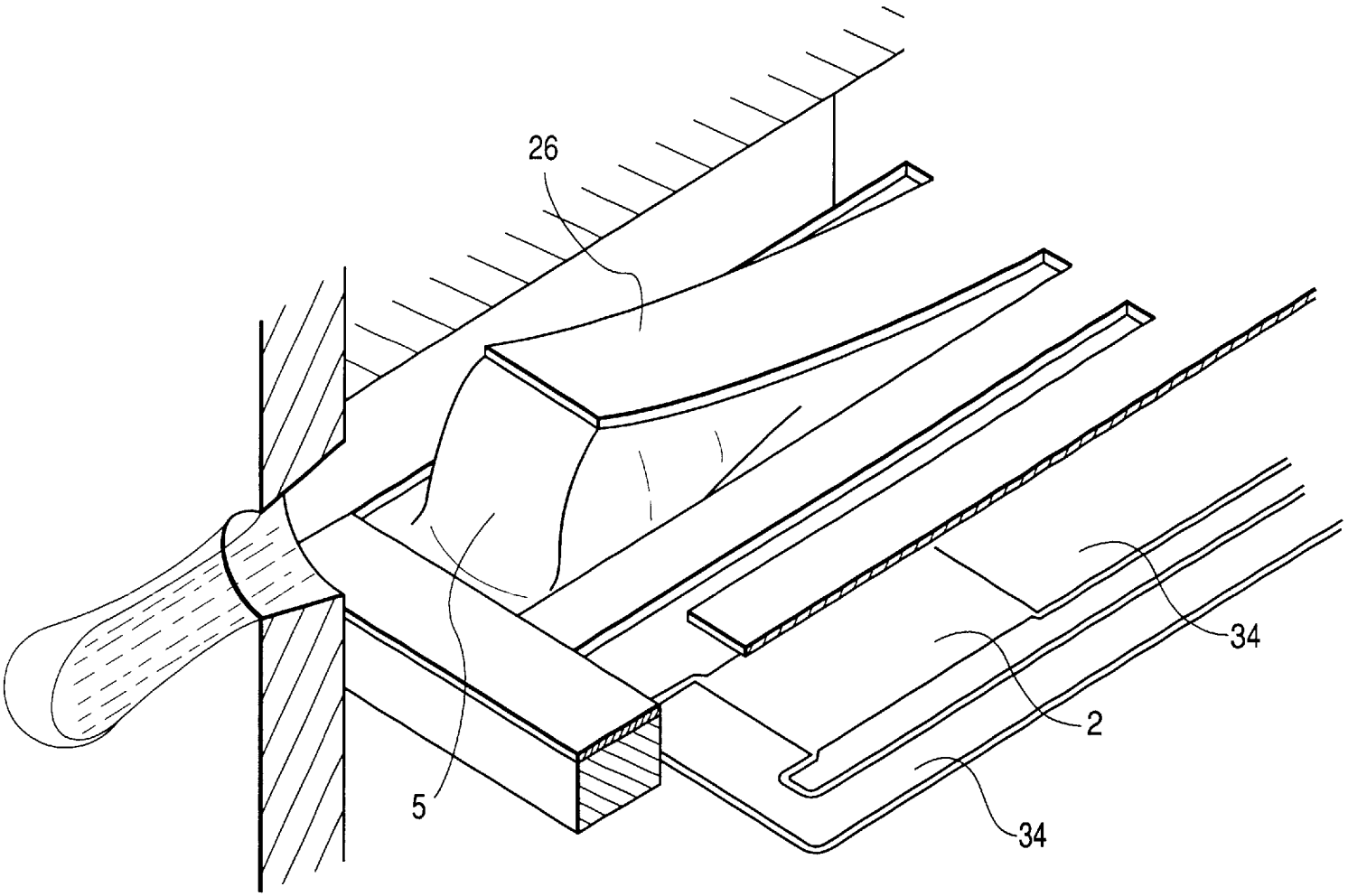
FIG. 5 is a perspective view of the liquid discharge head shown in FIGS. 4A to 4D.

FIG. 5 is a perspective view of the liquid discharge head of FIGS. 4A to 4D, illustrating substantially the same state as FIG. 4B. In the structure depicted herein, an electric current is fed by a wiring 34 to the heating element 2 as an electric resistor.

Now, the structure of the device substrate 1 which is provided with the heating element 2 fulfilling the role of imparting heat to the liquid will be explained below.

Figure 6A:
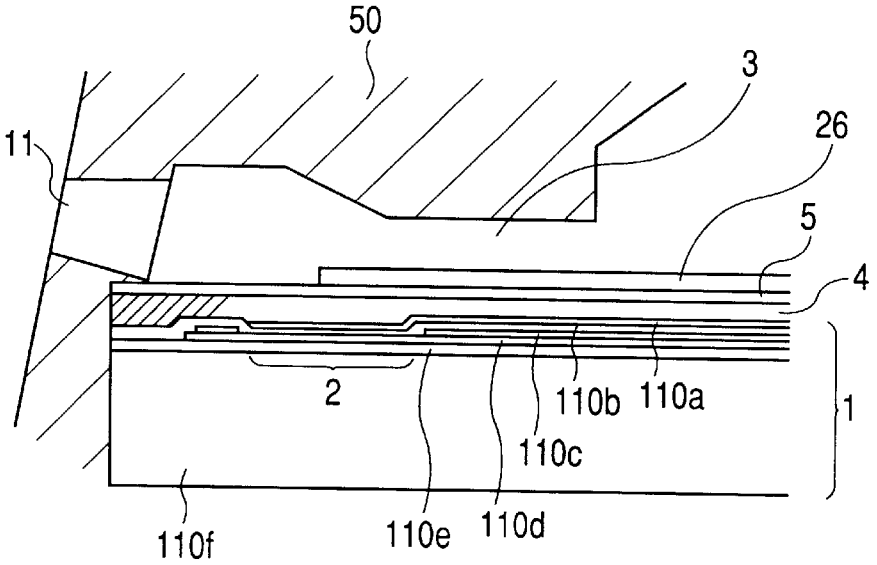
FIGS. 6A and 6B are longitudinal sections illustrating an example of the structure of a liquid discharge heat.
Figure 6B:
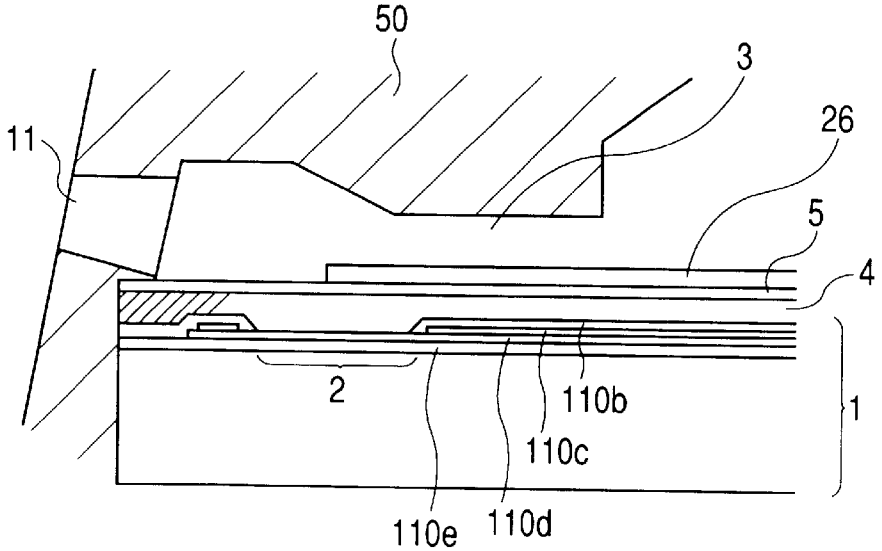

FIGS. 6A and 6B are longitudinal sections illustrating an example of the structure of the liquid discharge heat according to this invention; FIG. 6A representing a head furnished with a protective membrane which will be described specifically herein below and FIG. 6B representing a head devoid of an anti-cavitation layer as a protective membrane.

As illustrated in FIGS. 6A and 6B, the device substrate 1 seats a second flow path 4, a movable separation membrane 5 destined to form a separation wall, a movable member 26, a first flow path 3, and a grooved member 50 furnished with a groove for forming the first flow path 3.

On the device substrate 1, a silicon oxide film or silicon nitride film 110*e* aiming to offer insulation and storage of heat is formed on a base body 110*f* of silicon, for example, and an electric resistance layer 110*d*, 0.01 to 0.2 μm in thickness, of hafnium boride ($HfB_2$), tantalum nitride (TaN), or tantalum aluminum (TaAl), for example, intended to form a heating element and two wiring electrodes 110*c*, 0.2 to 1.0 μm in thickness, of aluminum, for example, are superposed thereon by patterning. The electric resistance layer 110*d* is incited to emit heat by applying a voltage from the two wiring electrode 110*c* to the electric resistance layer 110*d* thereby causing supply of an electric current to the electric resistance layer 110*d*. On the electric resistance layer 110*d* intervening between the wiring electrodes 110*c*, a protective layer 110*b*, 0.1 to 0.2 μm in thickness, of silicon oxide or silicon nitride, for example, is formed and an anti-cavitation layer 110*a*, 0.1 to 0.6 μm in thickness, of tantalum, for example, is further superposed thereon to protect the electric resistance layer 110*d* from various liquid such as ink.

Such a metallic material as tantalum (Ta), for example, is used for the anti-cavitation layer 110*a* because the pressure and the shock wave which arise during the birth and extinction of bubbles are very strong and seriously degrade the durability of rigid and brittle oxide film.

Optionally, the discharge head may be formed in such a structure by suitably combining liquids, flow path layouts, and resistance materials as obviates the anti-cavitation layer as a protective layer. One example of this structure is illustrated in FIG. 6B.

An iridium-tantalum-aluminum alloy, for example, may be cited as a material for the electric resistance layer which has no use for a protective layer. Particularly, for the sake of this invention, the absence of the protective layer proves to be rather advantageous because the bubbling liquid is rendered fit for bubble generating by being separated from the discharging liquid.

The structure of the heating element 2 in the mode of the embodiment described above is only required to have the electric resistance layer 110*d* (heating element) interposed between the wiring electrodes 110*c*. It may otherwise incorporate therein the protective layer 110*b* for protecting the electric resistance layer 110*d*.

The present example has been depicted as adopting for the heating element 2 a heating element formed of a resistance layer which is capable of emitting heat in response to an electric signal. This invention does not need to limit the heating element 2 to this particular structure but only requires it to be capable of producing in the bubbling liquid such bubbles as are necessary for causing discharge of the discharging liquid. As the heating element, such a photothermal converting device as emits heat on receiving the light like a laser beam or a heating device furnished with such a heating element as emits heat on receiving a high frequency may be adopted, for example.

Besides the electrothermal conversion element which is composed of the electric resistance layer 110*d* forming a heating element and the wiring electrode 110*c* for supplying an electric signal to the electric resistance layer 110*d*, the element substrate 1 mentioned above is allowed to have such functional elements as transistors, diodes, latches, and shift registers which are used for selectively driving the electrothermal conversion elements integrally incorporated therein during the process of semiconductor production.

For the purpose of discharging the liquid by driving the heating element provided in the device substrate 1 as described above, the resistance layer 110*d* interposed between the wiring electrodes is incited to generate heat promptly by applying a rectangular pulse to the electric resistance layer 110*d* via the wiring electrode 110*c*.

Figure 7:
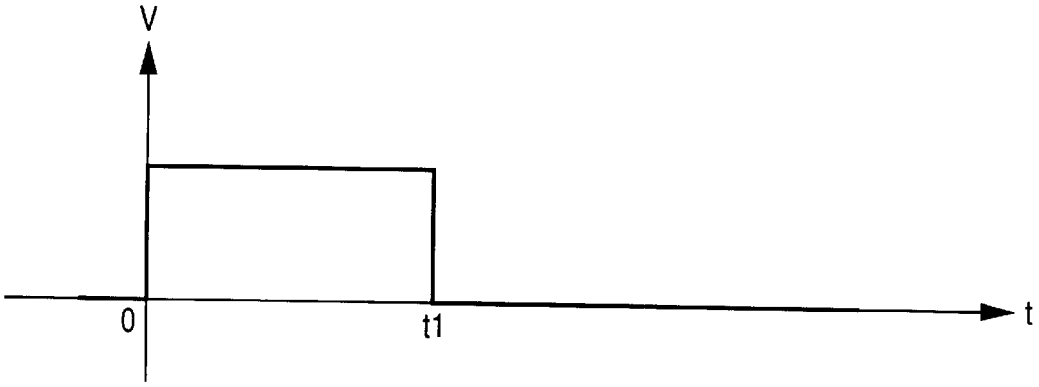
FIG. 7 is a diagram illustrating a voltage waveform to be applied to a heating element.

FIG. 7 is a diagram depicting the voltage waveform to be applied to the heating element 2 in the form of an electric resistance layer illustrated in FIGS. 6A and 6B.

In the head contemplated by the example described above, the heating element is set driving by the application thereto of an electric signal at 6 kHz under the conditions of 24 V of voltage, 7 $\mu$sec of pulse width, and 150 mA of electric current and, in consequence of the operation performed as described above, an ink as a liquid wished to be discharged is discharged through the discharge port. The conditions for the drive signal in this invention do not need to be limited to those mentioned above. The drive signal is only required to be capable of causing the bubbling liquid to bubble generating perfectly.

Figure 8:
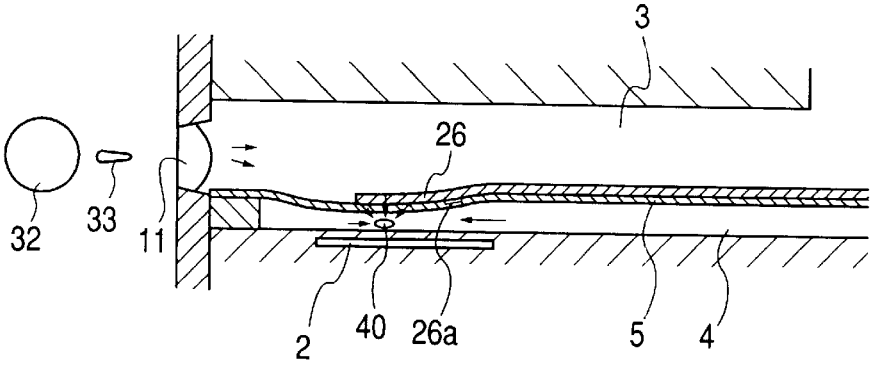
FIG. 8 is a diagram illustrating the state of union between a movable separation membrane and a movable member.

In the present example, the movable separation membrane 5 and the movable 26 are so constructed as to adhere fast to each other while the bubbles 40 are in the process of contraction as described above. One example of the structure consequently formed is illustrated in FIG. 8 which corresponds to FIG. 4D. In this example, the movable separation membrane 5 is joined to the free end side of the movable member 26 at the adhesive part 26*a* thereof. Owing to this union, the movable separation membrane 5 is restrained by the rigidity of the movable member 26 from being displaced toward the second flow path by the contraction of the bubbles 40.

As a consequence, the directionality of satellites described in the preceding example can be improved, the amount of satellite decreased to the extent of improving the print in quality, and the refill property exalted without suffering the large displacement of the movable separation membrane 5 toward the second flow path to add to the amount of retraction of meniscuses.

EXAMPLE 2

FIGS. 9A to 9D and FIGS. 10A and 10B are model diagrams of cross section in the direction of flow of liquid, illustrating the second example of the liquid discharge head of this invention.

Figure 9A:
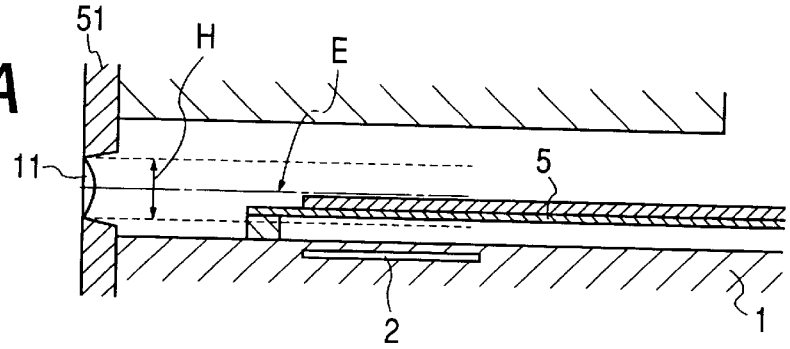
FIGS. 9A, 9B, 9C and 9D are model diagrams of cross section of direction of flow path for illustrating the second example of the liquid discharge head of the present invention.
Figure 9B:
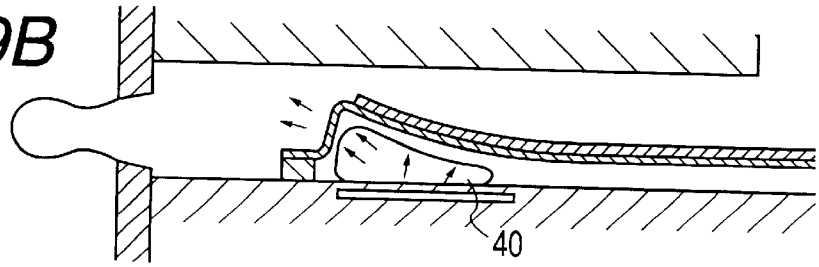
Figure 9C:
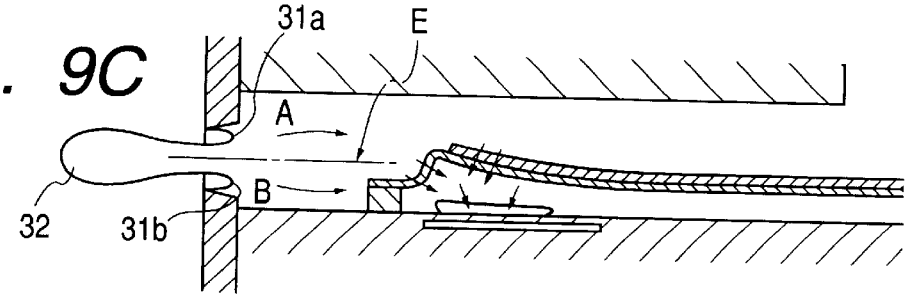
Figure 9D:
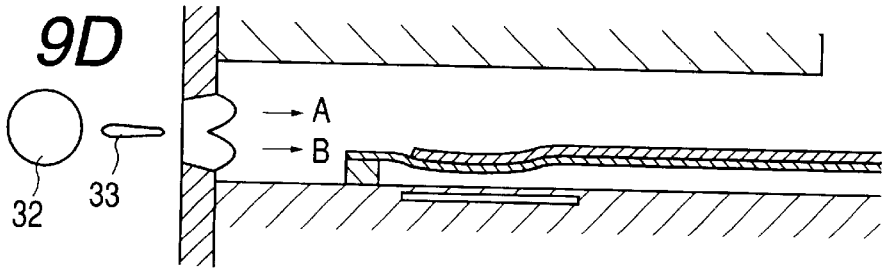

Similarly in the first example, FIG. 9A illustrates the state of the liquid discharge head during the absence of discharge of liquid and FIG. 9B to FIG. 9D illustrate the state thereof in the presence of liquid discharge.

In the first example, the leading terminal part of the movable separation membrane 5 is positioned below the lower part of the discharge port 11 so as to contact or approximate closely to an orifice plate 51. In the present example, it is disposed such that at least part of the displacement region of the movable separation membrane 5 in its initial state occurs in the substantial projected region H of the discharge port 11 along the center line E of the discharge port 11. The rest of the structure is the same as in the first example.

Figure 10A:
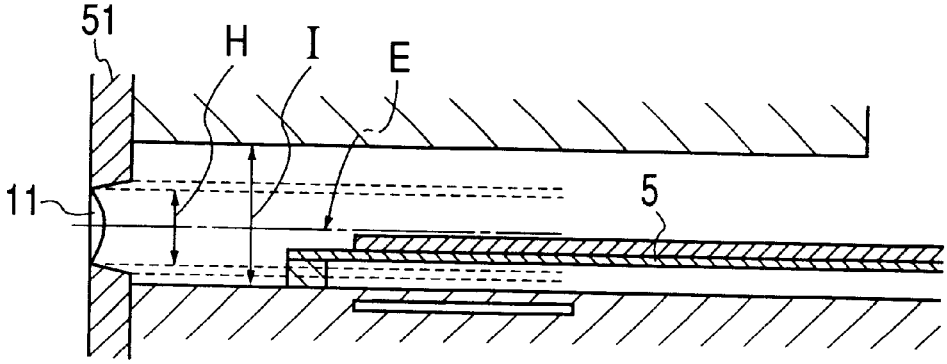
FIGS. 10A and 10B diagrams illustrating the projected region of a discharge port of the liquid discharge head.
Figure 10B:
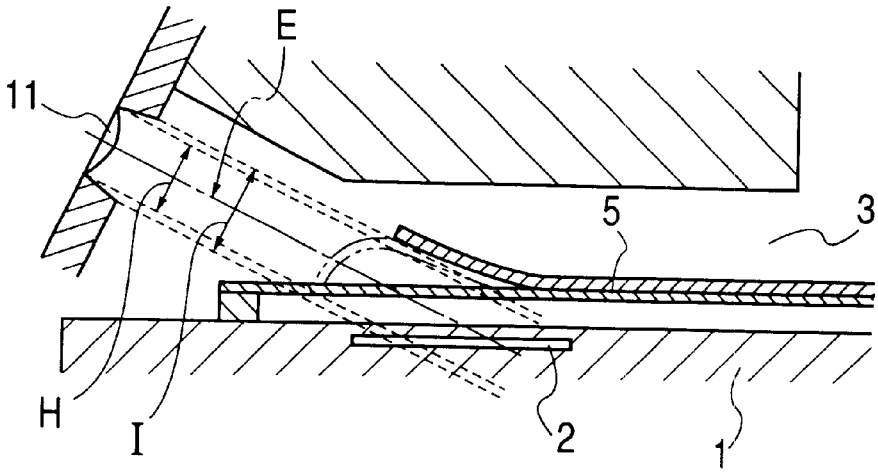

This structure, contrary to that of the first example, constitutes itself one example of decreasing the resistance of flow path and heightening the flow speed B when the effect of operating the movable member on the side farther from the movable separation membrane 4 and the flow speed A increases excessively and, consequently, attaining balanced control of the flow speeds A and B. As a result, the meniscuses 31*a* and 31*b* can be symmetrized in shape relative to the central line E of the discharge port 11 and the direction of the satellites can be equalized to that of the main drops 32. Incidentally, the projected region of the discharge port 11 along the central line E of the discharge port 11, as illustrated in FIG. 10A, embraces the projected region 1 of the flow path side opening. Even when the central line E of the discharge port 11 forms an angle with the flow path as illustrated in FIG. 10B, this invention can be applied to the structure under discussion by the principle described above so long as the discharge port 11 falls on the downstream side of the displacement region of the movable separation membrane 5.

EXAMPLE 3

Figure 11A:
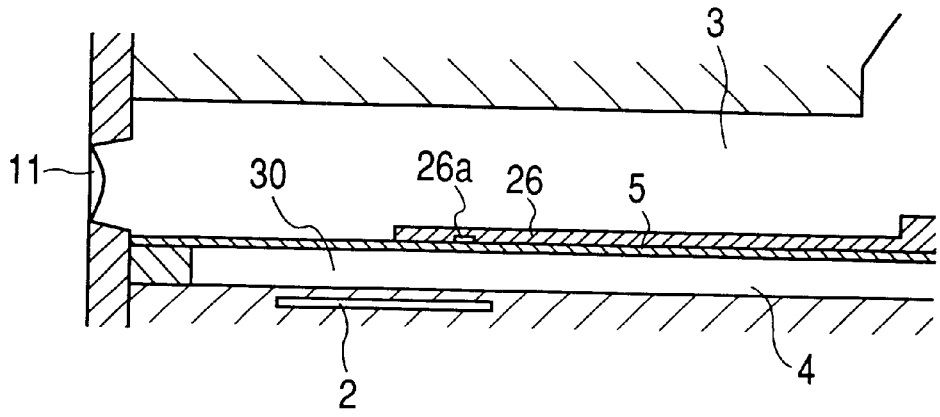
FIGS. 11A and 11B are model diagrams of cross section of direction of flow path for illustrating the third example of the liquid discharge head of the present invention.
Figure 11B:
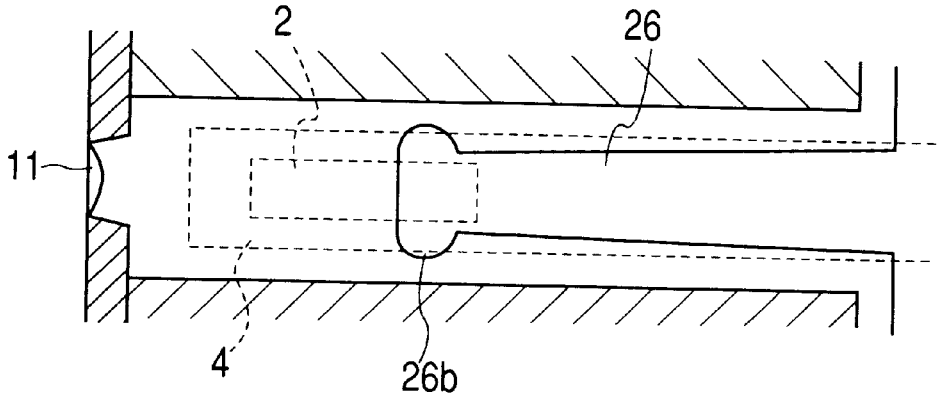

FIGS. 11A and 11B are model diagrams of cross section of the direction of flow path illustrating the third example of the liquid discharge head of this invention; FIG. 11A representing a cross section taken in the direction of flow path and FIG. 11B a plan view of the direction of flow path.

The present example, as illustrated in FIGS. 11A and 11B, differs from the first example solely in respect that a lower displacement restraining part 26*b* capable of allowing the movable member 26 to have a greater width than the second flow path 4 is disposed near the free end of the movable member 26 and that the movable separation membrane 5 and the movable member 26 are joined fast to each other at the adhesive part 26*a*. The rest of the construction is the same as that of the first example.

In the liquid discharge heat produced in the structure described above, when the movable separation membrane 5 and the movable member 26 tend to displace toward the second flow path 4 in consequence of the contraction of the bubbles (not shown), the movable separation membrane 5 also is restrained by the adhesive part 26*a* from displacing toward the second flow path 4 because the lower displacement restraining part 26*b* prevents the movable member 26 from displacing toward the second flow path 4 from the position assumed before the displacement.

As a result, the retraction of the meniscuses which is caused proportionately by the decrease of the volume of the liquid due to the displacement on the first flow path 3 side when the movable member 26 displaces toward the second flow path 4 can be repressed and the refill time can be curtained.

The lower displacement restraining part 26*b* mentioned above may be in such a structure as to effect partial repression of the displacement toward the second flow path 4 instead of causing the displacement toward the second flow path 4 completely as in the present example.

Now, an example of the structure of the liquid discharge head which incorporates two common liquid chambers without sacrificing the effort to decrease the number of component parts, allows efficient introduction of different liquids to the common liquid chambers as perfectly separated, and further permits a reduction in cost will be described below.

Figure 12:
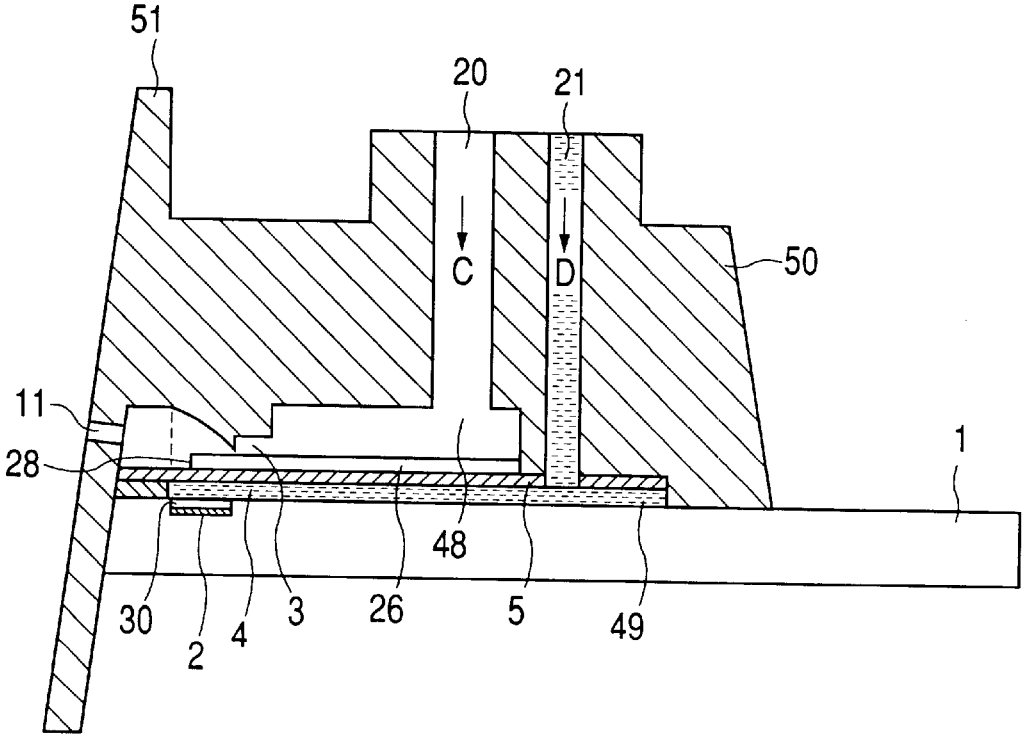
FIG. 12 is a model diagram illustrating an example of the structure of the liquid discharge head of this invention.

FIG. 12 is a model diagram illustrating an example of the structure of the liquid discharge head of this invention. In this diagram, like component parts illustrated in FIGS. 1A to 1E through FIGS. 11A and 11B will be denoted by like reference numerals. These component parts will be omitted from the following specific description.

The grooved member 50 in the liquid discharge head illustrated in FIG. 12 is roughly composed of the orifice plate 51, a plurality of grooves destined to form a plurality of first flow paths 3, and a recess destined to form a first common liquid chamber 48 communicating with the plurality of first flow paths 3 and supplying a liquid (discharging liquid) to the first flow paths 3.

The plurality of first flow paths 3 are formed by joining the movable separation membrane 5 to the lower side part of this grooved member 50. The grooved member 50 is furnished with a first liquid feeding path 20 extending from the upper part thereof to the interior of the first common liquid chamber 48 and a second liquid feeding path 21 extended from the upper part thereof to the interior of a second common liquid chamber 49 through the movable separation membrane 5.

The movable member 26 joined tightly to the upper side of the movable separation membrane 5 mentioned above is disposed to confront the bubble generating region 30 with the free end thereof pointed in the direction of the discharge port. The free end of the movable member is positioned on the discharge port side relative to the center of the area of the heating element 2.

The first liquid (discharging liquid) is supplied via the first liquid feeding path 20 and the first common liquid chamber 48 to the first flow path 3 as indicated by an arrow mark C in FIG. 12 and the second liquid (bubbling liquid) is supplied via the second fluid feeding path 21 and the second common liquid chamber 49 to the second flow path 4 as indicated by an arrow mark D in FIG. 12.

While the present example is depicted as disposing the second liquid feeding path 21 and the first liquid feeding path 20 parallelly to each other, the present invention does not need to use these paths in this particular layout. They may be incorporated in any arbitrary layout so long as they penetrate the movable separation membrane 5 disposed outside the first common liquid chamber 48 and communicate with the second common liquid chamber 49.

The thickness (diameter) of the second liquid feeding path 21 is fixed in consideration of the amount of the second liquid to be supplied. The cross section of the second liquid feeding path 21 does not need to be a circle but may be a rectangle, for example.

The second common liquid chamber 49 can be formed by properly partitioning the grooved member 50 with the movable separation membrane 5. Specifically, the second common liquid chamber 49 and the second flow path 4 may be constructed, for example, by forming a common liquid chamber frame and a second flow path wall with a dry film on the device substrate 1 and then pasting to the device substrate 1 the union obtained by combining the movable separation membrane 5 with the grooved member 50 fixing the movable separation membrane 5 in position.

Figure 13:
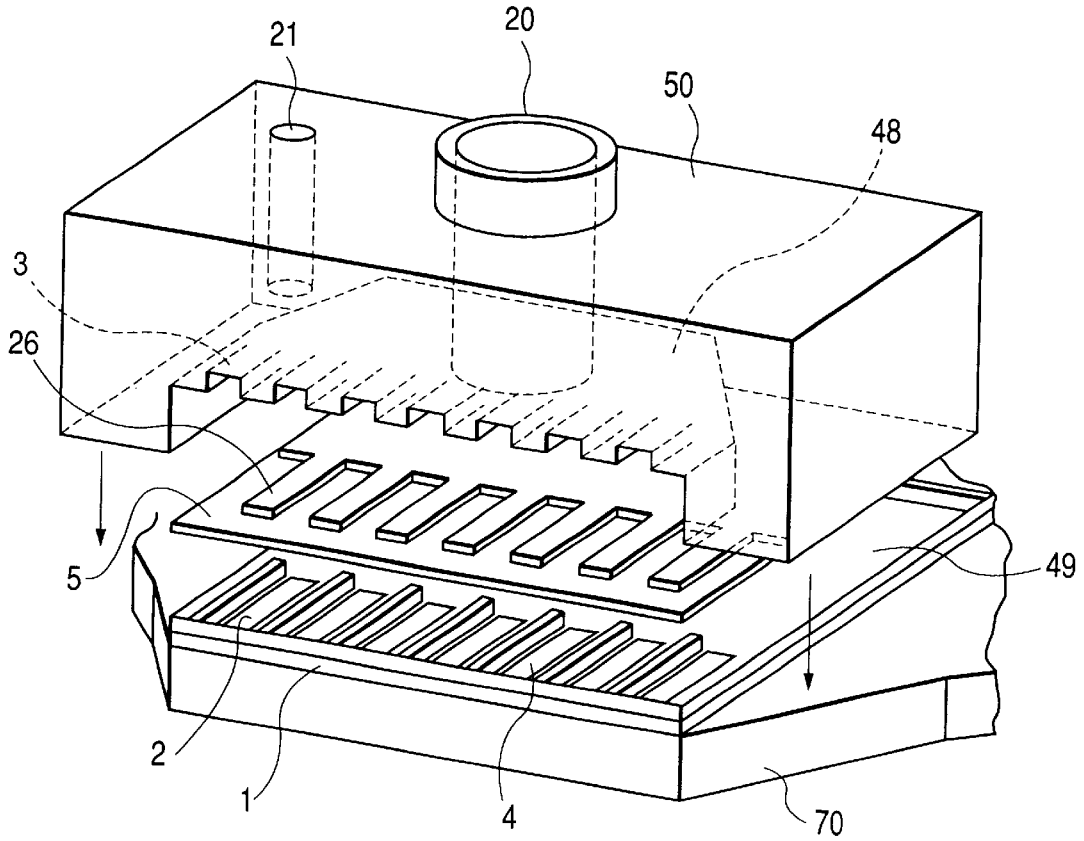
FIG. 13 is an exploded perspective view illustrating an example of the structure of the liquid discharge head of this invention.

FIG. 13 is an exploded perspective view illustrating one example of the structure of the liquid discharge head of this invention.

In the present mode, the device substrate 1 furnished with a plurality of electrothermal conversion elements, i.e. heating elements 2 for generating the heat necessary for the generation of bubbles in the bubbling liquid by membrane boiling as described above is formed on a supporting member 70 which is formed of such metal as aluminum.

On the device substrate 1, a plurality of grooves destined to form second flow paths 4 defined by second flow path walls, a recess for forming the second common liquid chamber (common bubbling liquid chamber) 49 communicating with a plurality of second flow paths 4 and feeding the bubbling liquid severally to the second flow paths 4, and the movable separation membrane 5 furnished with the movable member 26 are provided.

The grooved member 50 is provided with a groove adapted to form the first flow path (discharging liquid flow path) 3 in combination with the movable separation membrane 5, a recess for forming the first common liquid chambers (common discharging liquid chambers) 48 communicating with the discharging liquid flow path and supplying the discharging liquid severally to the first flow paths 3, the first liquid feeding path (discharging liquid feeding path) 20 for supplying the discharging liquid to the first common liquid chambers 48, and the second liquid feeding path (bubbling liquid feeding path) 21 for supplying the bubbling liquid to the second common liquid chamber 49. The second liquid feeding path 21 is connected to the communicating path which penetrates the movable separation membrane 5 disposed outside the first common liquid chamber 48 and communicates with the second common liquid chamber 49 and, owing to this communicating path, is enabled to supply the bubbling liquid to the second common liquid chamber 48 without being mixed with the discharging liquid.

As regards the relative layout of the device substrate 1, the movable separation membrane 5 furnished with the movable member 26, and the grooved member 50, the movable member 26 is disposed correspondingly to the heating element 2 of the device substrate 1 and the first flow path 3 is disposed correspondingly to the movable member 26. Though the present embodiment is depicted as having the second liquid feeding path 21 disposed on one grooved member 60, this invention allows incorporation of a plurality of such second liquid feeding paths 21 depending on the amount of the relevant liquid to be supplied. The cross-sectional areas of the first liquid feeding path 20 and the second liquid feeding path 21 may be fixed proportionately to the amounts of liquid to be supplied. The component parts of the grooved member 50 can be miniaturized by optimizing these cross-sectional areas.

In the present mode, the number of component parts can be decreased, the process of operation shortened, and the cost of operation cut by the fact that the second liquid feeding path 21 for supplying the second liquid to the second flow path 4 and the first liquid feeding path 20 for supplying the first liquid to the first flow path 3 are formed of one same grooved top plate as the grooved member 50 as described above.

The supply of the second liquid to the second common liquid chamber 49 which communicates with the second flow path 4 is accomplished by means of the second flow path in the direction of piercing the movable separation membrane 5 which separates the first and the second liquid from each other. Since the process of pasting the movable separation membrane 5 and the grooved member 50 to the device substrate 1 having formed therein the heating element 2, therefore, can be performed all at once, the ease of manufacture is exalted, the accuracy of union by pasting improved, and the discharge of liquid attained satisfactorily.

The supply of the second liquid to the second flow path 4 is effected infallibly because the second liquid is supplied through the movable separation membrane 5 to the second common liquid chamber 49. The discharge of liquid, therefore, is stabilized because the supply is amply secured.

Owing to the structure incorporating therein the movable separation membrane 5 which has the movable member attached tightly to the upper side thereof as described above, the liquid discharge head of this invention causes discharge of liquid with high discharging force and high discharge efficiency and quickly as compared with the conventional liquid discharge head.

The bubbling liquid to be used may be a liquid of such quality as specified above. As concrete examples of the bubbling liquid fit for use herein, methanol, ethanol, n-propanol, isopropanol, n-hexane, n-heptane, n-octane, toluene, xylene, methylene dichloride, triclene, Freon TF, Freon BF, ethyl ether, dioxane, cyclohexane, methyl acetate, ethyl acetate, acetone, methylethyl ketone, water, and mixtures thereof may be cited.

As the discharging liquid, a varying liquid may be used without reference to bubble generation properties and thermal properties. Even a liquid of poor bubble generation properties, a liquid readily degenerated or deteriorated by heat, or a liquid of unduly high viscosity which has not been easily discharged by the conventional discharge head can be effectively utilized.

As the quality proper for any discharging liquid, the discharging liquid to be used herein is preferred to avoid interfering with the action of discharging or bubble generating or with the operation of the movable separation membrane or the movable member owing to the reaction of its own or with the bubbling liquid.

As the discharging liquid for recording, a highly viscous ink may be utilized.

Besides, such liquids as medicines and perfumes which are vulnerable to heat may be utilized.

Bubbling liquids and discharging liquids of the following compositions were used in varying combinations to effect discharge of the discharging liquids and produce records. A review of the records reveals that not only liquids of a viscosity of ten-odd cp which were not easily discharged with the conventional head but also liquids of such very high viscosity as 150 cp could be discharged satisfactorily to produce records of high image quality.

Bubbling liquid 1—Ethanol 40 wt. %
Water 60 wt. %
Bubbling liquid 2—Water 100 wt. %
Bubbling liquid 3—Isopropyl alcohol 10 wt. %
Water 90 wt. %
Discharging liquid 1—Carbon black 5 wt. %
(Pigment ink about 15 cp) Styrene-acrylic acid-ethyl acrylate copolymer dispersion agent (oxidation 140, weight average molecular weight 8000) 1 wt. %
Monoethanol amine 0.25 wt. %
Glycerin 6.9 wt. %
Thiodiglycol 5 wt. %
Ethanol 3 wt. %
Water 16.75 wt. %
Discharging liquid 2 (55 cp)—Polyethylene glycol 200 100 wt. %
Discharging liquid 3 (150 cp)—Polyethylene glycol 600 100 wt. %

Incidentally, in the case of a liquid heretofore held to be discharged only with difficulty, the low discharge speed aggravated the dispersion of the directionality of discharge and impaired the precision of landing of dots on a recording paper and the unstability of discharge resulted in dispersing the amount of discharge and consequently rendering difficulty the production of an image of high quality. In the structure according to the mode of embodiment described above, however, the generation of bubbles could be attained amply and stably by the use of the bubbling liquid. This fact allowed improvement of the precision of landing of liquid drops and stabilization of the amount of ink discharge and conspicuously improved the quality of a recorded image.

Now, the process for the production of the liquid discharge head of this invention will be described below.

Broadly, the manufacture of the head was effected by forming the wall of a second flow path on the device substrate, fitting thereon the movable separation membrane furnished with the movable member, and fitting further thereon the grooved member containing a groove for forming the first flow path. Otherwise, it was attained by forming the wall of the second flow path and then joining onto the wall the grooved member having fitted thereto the movable separation membrane furnished with the movable member.

The method for manufacturing the second flow path will be described more specifically below.

First, the electrothermal conversion element furnished with the heating element made of hafnium boride or tantalum nitride was formed on the device substrate (silicon wafer) by the use of the same device of manufacture as that used for a semiconductor and then the surface of the device substrate was cleaned for the purpose of improving the tight adhesion of the surface to a photosensitive resin in the subsequent step. For further improving the tight adhesion, it suffices to subject the surface of the device substrate to a treatment with ultraviolet light and oregion and then apply to the treated surface by spin coating a solution obtained by diluting a silane coupling agent (made by Nihon Unica K.K. and sold under the product code of "A189") to a concentration of 1 wt. % with ethyl alcohol.

Then, the resultant surface was cleaned and an ultraviolet-sensitive resin film (made by Tokyo Ohka K.K. and sold under the trademark designation of "Dry Film Odil SY-318") DF was laminated on the substrate having the tight adhesion thereof improved.

Subsequently, a photomask PM was laid on the dry film DF and the portion of the dry film DF required to remain as a second flow path wall was exposed to the ultraviolet light through the photomask PM. This step of exposure was effected by the use of an instrument (made by Canon Inc.

and sold under the product code of "MPA-600") with an exposure of about 600 mJ/cm$^2$.

The dry film DF was then developed with a developer (made by Tokyo Ohka K.K. and sold under the product code of "BMRC-3") formed of a mixture of xylene with butyl cellosolve acetate to dissolve out the unexposed part and obtain the exposed and hardened part as the wall part of the second flow path 4. The residue still persisting on the surface of the device substrate 1 was removed by about 90 seconds' treatment with a plasma ashing device (produced by Arukantec Inc. and sold under the product code of "MAS-800"). The substrate was subsequently exposed to the ultraviolet light projected at a rate of 100 mJ/cm$^2$ at 150° C. for two hours to harden perfectly the exposed part.

The second flow paths could be formed with high precision uniformly on a plurality of heater boards (device substrates) fabricated as cut from the silicon substrate by the method described above. Specifically, the silicon substrate was cut into the individual heater boards 1 with the dicing machine (made by Tokyo Seimitsu K.K. and sold under the product code of "AWD-4000") fitted with a diamond plate, 0.05 mm in thickness. The separated heater boards 1 were fixed with an adhesive agent (made by Toray Industries, Inc. and sold under the product code of "SE4400") on an aluminum base plate.

Then, the print substrate joined in advance to the aluminum base plate and connected to the heater boards with an aluminum wire, 0.05 mm in diameter.

Subsequently, the unions resulting from joining the grooved members joined to the movable separation membranes were joined as aligned to the heater boards obtained as described above. To be specific, the grooved members furnished with the movable separation membranes and the heater boards were aligned to each other and joined and fixed with a rebound leaf. Then, ink-bubbling liquid feeding members were joined and fixed on the aluminum base plates. The gaps between the aluminum wires and the gaps between the grooved member, the heater boards, and the ink bubbling liquid feeding members were sealed with a silicone sealer (made by Toshiba Silicone K.K. and sold under the product code of "TSE 399") to complete the manufacture.

By forming the second flow paths in accordance with the method of production described above, the flow paths can be obtained with high precision without any positional deviation from the heaters of the heater boards mentioned above. Particularly by having the grooved members and the movable separation membranes joined in advance to each other in the preceding step, the positional precision of the first flow paths and the movable members can be exalted. The high-precision production technique described above stabilizes the discharge of liquid and improves the quality of print. Further, the fact that the component parts are formed collectively on the wafer permits quantity production of the liquid discharge heads at a low cost.

The present mode of embodiment has been depicted as using an ultraviolet hardening type dry film for the formation of the second flow paths. Otherwise, the formation of the second flow paths may be attained by adopting a resin having an absorption band near the ultraviolet region, particularly a region of 248 nm, laminating the resin, hardening the resultant laminate, and directly removing the part of the laminate wished to form the second flow path with an excimer laser.

Now, the method for the production of the movable separation membrane furnished with the movable member specified above will be described below.

FIGS. 14A to 14H are diagrams depicted to aid in the description of the process of manufacturing the movable separation membrane in the liquid discharge head according to this invention.

Figure 14A:
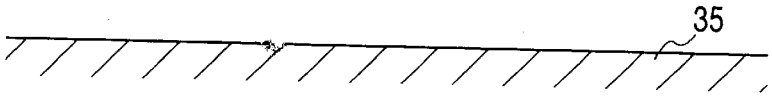
FIGS. 14A, 14B, 14C, 14D, 14E, 14F, 14G, and 14H are diagrams to aid in the description of a process for the manufacture of a movable separation membrane in the liquid discharge head of this invention.
Figure 14B:
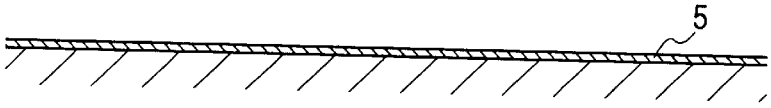

To begin with, a mold release agent is applied on a mirror wafer (silicon wafer) 35 of silicon as illustrated in FIG. 14A. Then, a liquid polyimide resin destined to form the movable separation membrane is deposited by spin coating to form a film (movable separation membrane) 5, about 3 μm in thickness, as illustrated in FIG. 14B.

Figure 14C:
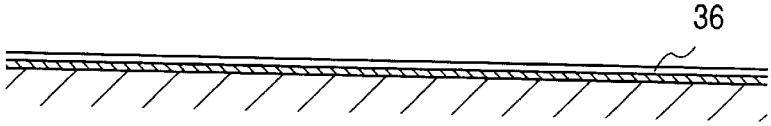
Figure 14D:
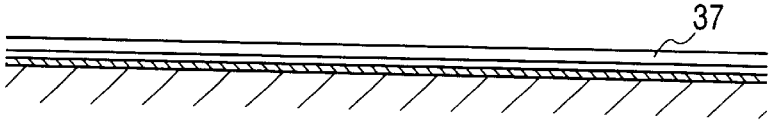
Figure 14E:
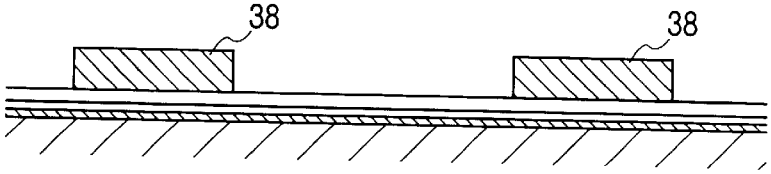

On the film, a metal thin film 36 is deposited as by sputtering in a thickness of 0.1 μm as illustrated in FIG. 14C. This metal thin film 36 is coated with a film, about 5 μm in thickness, as by plating as illustrated in FIG. 14D. On the last formed film is formed a pattern of resist 38 as illustrated in FIG. 14E.

Figure 14F:
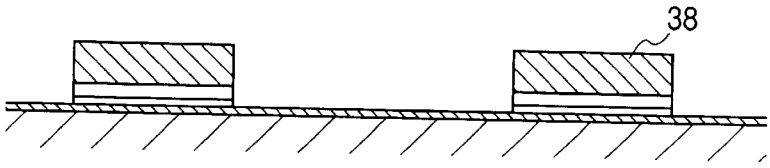
Figure 14G:
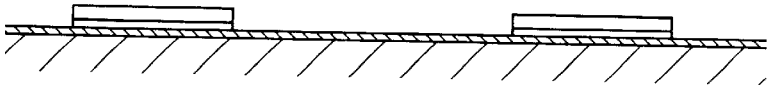

Then, the metallic part of the resultant laminate excepting the resist 38 is peeled by etching as illustrated in FIG. 14F and the resist 38 is removed as illustrated in FIG. 14G.

Figure 14H:
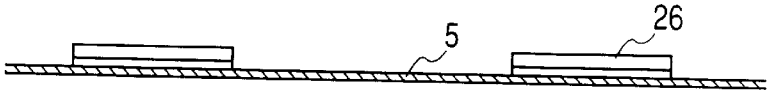

Finally, the one-piece unit composed of the movable separation membrane and the movable member is peeled off the silicon wafer 35 as illustrated in FIG. 14H.

(Mode of Second Embodiment)

Figure 15A:
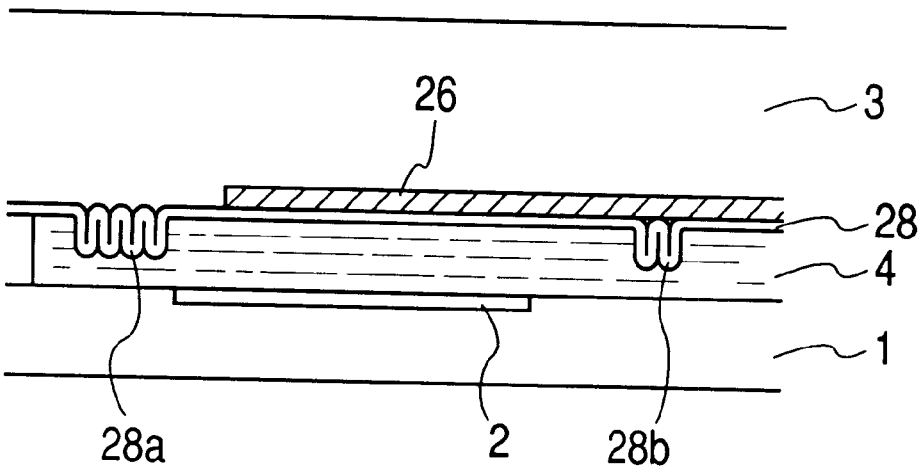
FIGS. 15A and 15B are model diagrams of cross section of the direction of liquid flow illustrating the mode of the second embodiment of the liquid discharge head of this invention.
Figure 15B:
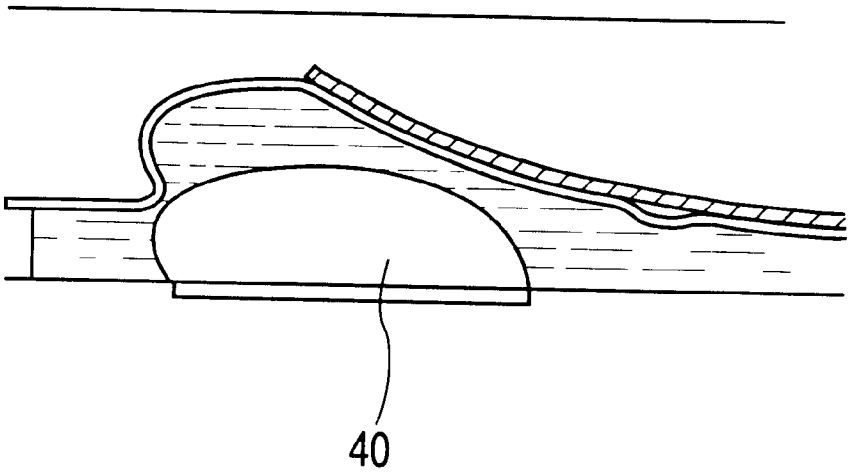

FIGS. 15A and 15B are model diagrams of cross section of the direction of flow path illustrating the mode of the second embodiment of the liquid discharge head according to this invention; FIG. 15A representing the state of the liquid discharge head during the absence of liquid discharge and FIG. 15B the state thereof during the presence of liquid discharge.

In the present mode, slack parts 28*a* and 28*b* are disposed respectively in the former and the latter part of the movable separation membrane 28. Since the pressure generated by the formation of bubbles extends the slack parts 28*a* and 28*b*, the volume of the bubbles 40 can be effectively utilized for the deformation of the movable separation membrane 28. The discharging force of greater magnitude can be attained more efficiently, therefore, because the movable member 26 is displaced more largely toward the first flow path 3 consequently. The direction of the slack parts 28*a* and 28*b* imposes no specific restriction because the pressure generated in consequence of the formation of bubbles is only required to expand the slack parts 28*a* and 28*b* in the direction of the discharge port. The rest of the structure is identical with the structure involved in the mode of the first embodiment. The movable separation membrane 28 is enabled to acquire an exalted discharge efficiency by being furnished with such slack parts as mentioned above. The present example does not require the membrane itself to possess expansibility.

The movable separation membrane 28 is formed in a uniform thickness by the same procedure as in the mode of the first embodiment described above.

The movable member 26 is manufactured by electrically casting nickel. The method of manufacture by the electrical casting of nickel comprises applying a resist on a substrate of SUS in a thickness of 5 μm and then patterning the deposited resist in the shape of a row of continued comb teeth so as to facilitate the assemblage of a plurality of movable members adapted to correspond to the flow paths and continue within the common liquid chambers.

Then, the SUS substrate is electrically plated with a nickel layer, again 3 μm in thickness. The plating liquid used in this case is composed of nickel sulfofmate, a stress allaying agent (made by World Metal K.K. and sold under the trademark designation of "Zeroall"), boric acid, a bit preventive (made by World Metal K.K. and sold under the product code of "NP-APS"), and nickel chloride. The application of an electric field in the electrodeposition is effected by setting a relevant electrode on the anode side, fitting the patterned SUS substrate on the cathode side, keeping the plating liquid at a temperature of 50° C., and fixing the current density at 5 A/cm$^2$.

After the SUS substrate has been plated as described above, it is deprived of the part of nickel layer by exposure to an ultrasonic oscillation. Consequently, the movable member wished to be obtained is produced.

Meanwhile, a heater board having electrothermal conversion elements superposed thereon is formed on a silicon wafer by the use of the same facility as normally used for a semiconductor. On the wafer, the second bubbling liquid flow path is formed in advance as with dry film similarly in the mode of the first embodiment described above. The wafer is separated into individual heater boards with a dicing machine. The heater board is joined to an aluminum base plate to which a printed substrate has been joined preparatorily and the printed substrate is connected to an aluminum wire to give rise to an electric wiring. The liquid discharge head aimed at is completed by pasting the movable separation membrane 28 on the heater board in the ensuant state, then aligning the movable member 26 manufactured by the procedure described above to the heating element 2 and joining them, then setting the grooved member in position and joining it to the other component parts already in plate with the aid of a retaining spring.

Though the present mode has been depicted as using nickel in the movable member, this invention does not preclude use of other metal instead. The movable member is only required to possess elasticity necessary for affording a satisfactory operation at all.

The materials which are preferably used for the movable members include such metals as silver, nickel, gold, iron, titanium, aluminum, platinum, tantalum, stainless steel, and phosphor bronze which abound in durability and alloys of these metals, resins such as acrylonitrile, butadiene, and styrene which have a nitrile group, resins such as polyamides which have an amide group, resins such as polycarbonate which have a carboxyl group, resins such as polyacetal which have an aldehyde group, resins such as polysulfones which have a sulfone group, other resins such as liquid crystal polymers and compounds thereof, metals such as gold, tungsten, tantalum, nickel, stainless steel, and titanium which offer high resistance to inks, alloys of these metals, materials coated with these metals or alloys for the sake of resistance to inks, resins such as polyamides which have an amide group, resins such as polyacetals which have an aldehyde group, resins such as polyether ether ketones which have a ketone group, resins such as polyimides which have an imide group, resins such as phenol resins which have a hydroxyl group, resins such as polyethylenes which have an ethyl group, resins such as epoxy resins which have an epoxy group, resins such as melamine resins which have an amino group, resins such as xylene resins which have a methylol group, and compounds thereof, and ceramics such as silicon dioxide, and compounds thereof, for example.

The materials which are preferably used for the movable separation membranes include such engineering plastics of the recent development as, for example, polyethylene, polypropylene, polyamide, polyethylene terephthalate, melamine resins, phenol resins, polybutadiene, polyurethane, polyether ether ketone, polyether sulfones, polyarylate, silicone rubber, and polysulfones which excel in resistance to heat, resistance to solvents, and moldability, exhibit elasticity, and permit production of thin films, and compounds of the plastics in addition to the polyimides mentioned above.

The thickness of the movable separation membrane 28 may be decided in consideration of the material, shape, etc. of the membrane from the viewpoint of attaining the strength proper for any separation wall and producing the actions of expansion and contraction satisfactorily. Generally, this thickness is preferred to fall in the approximate range of 0.5 to 10 $\mu$m.

Since this invention is constructed as described above, it manifests the following effects. In the present example, part of the effect of this invention is attained even in the absence of elasticity because the slack pack 28*a* is used at the relevant portion.

It goes without saying that this invention, owing to its principle, can be applied to the type of liquid discharge head which is provided with the discharge port at a position opposite the surface of the heating element.

Since the present invention is constructed as described above, it manifests the following effects.

(1) The liquid can be efficiently discharged with high discharging force through the discharge port.

(2) The speed of refill is heightened and the discharge is stably attained even in the printing performed at a high speed.

(3) Even when the discharging liquid which is used happens to be made of a material vulnerable to heat, the amount of a deposit suffered to pile on the heating element can be decreased and the freedom of selection of the discharging liquid can be widened.

(4) The amount of satellites contained in the discharged liquid can be decreased and the image produced by printing can be improved in quality.

(5) The quality of the image can be further exalted by uniformizing the meniscuses in shape and stabilizing the direction of satellites.

What is claimed is:

1. A method for discharge of a liquid from a head having a first flow path adapted to discharge the liquid from an upstream side to a down-stream side toward a discharge port, a second flow path provided with a bubble generating region for generating a bubble in the liquid, a movable separation membrane which maintains the first and second flow paths substantially separated and which is movable over a displacement range, and a movable member having a free end on the discharge port side and adapted to move in concert with the displacement range, of the movable separation member, said method comprising:

displacing said movable separation membrane with said bubble, displacement being into the first flow path and being more on the downstream side than on the upstream side within the displacement range of said movable separation membrane;

discharging said liquid via the discharge port by virtue of the displacement of said movable separation membrane; and repressing retraction of a meniscus of liquid via said discharge port into said first flow path by regulating a return speed of said movable separation membrane on the upstream side to a level higher than a return speed of said movable separation membrane on the downstream side;

wherein said movable member regulates said return speeds during the return of the movable separation membrane toward the second flow path in consequence of the contraction of the bubble.

2. A method for discharge of a liquid from a head having a first flow path adapted to discharge the liquid from an upstream side to a downstream side toward a discharge port, a second flow path provided with a bubble generating region for generating a bubble in the liquid, a movable separation membrane which maintains the first and second flow paths substantially separated and which is movable over a displacement range, and a movable member having a free end on the discharge port side and adapted to move in concert with the displacement range of the movable separation member, said method comprising:

displacing said movable separation membrane with said bubble, displacement being into the first flow path and being more on the downstream side than on the upstream side within the displacement range of said movable separation membranes;

discharging the liquid via the discharge port by virtue of the displacement of said movable separation membrane; and forming a distribution of meniscus retraction substantially symmetrized relative to a central line of said discharge port by regulating a return of said movable separation membrane toward said second flow path in consequence of contraction of the bubble;

wherein said movable member regulates the return during the return of said movable separation membrane toward said second flow path in consequence of the contraction of the bubble.

3. A method for discharge of a liquid from a head having a first flow path adapted to discharge the liquid from an upstream side to a downstream side toward a discharge port, a second flow path provided with a bubble generating region for generating a bubble in the liquid, and a movable separation membrane which maintains the first and second flow paths substantially separated and which is movable over a displacement range, said method comprising:

displacing said movable separation membrane with said bubble, displacement being into the first flow path and being more on the downstream side than on the upstream side within the displacement range of said movable separation membrane;

discharging said liquid via said discharge port by virtue of the displacement of said movable separation membrane; and forming a distribution of meniscus retraction substantially symmetrized relative to a central line of said discharge port by allowing at least part of a displaced region of said movable separation membrane to be present in an initial state in a substantially projected region of said discharge port along a central line of said discharge port during return of said movable separation membrane toward said second flow path in consequence of contraction of the bubble.

4. A liquid discharge head comprising:

a first flow path communicating with a discharge port for discharging a liquid, the first flow carrying the liquid from an upstream side thereof to a downstream side toward said discharge port;

a second flow path provided with a bubble generating region for generating a bubble by operating an energy generating element on the liquid;

a movable separation membrane for substantially separating said first flow path and said second flow path from each other and effecting discharge of the liquid by displacement with the bubble on the upstream side of said first flow path; and a direction regulating device for regulating a direction of movement of said movable separation membrane during the displacement of said movable separation membrane toward said second flow path in consequence of contraction of the bubble.

5. A liquid discharge head according to claim 4, wherein said direction regulating device comprises a movable member furnished with a free end in the direction of said discharge port opposed to said bubble generating region across said movable separation membrane and said movable member and said movable separation membrane are joined fast to each other in at least part thereof.

6. A liquid discharge head according to claim 5, wherein said energy generating element comprises a heating element for generating heat for the generation of said bubble furnished at a position in said bubble generating region opposite said movable member.

7. A liquid discharge head according to claim 6, wherein a downstream part of the bubble generated in said bubble generating region is generated on a downstream side from the center of an area of said heating element.

8. A liquid discharge head according to claim 7, wherein said movable member is shaped like a plate.

9. A liquid discharge head according to claim 7, wherein said movable separation membrane is formed of resin.

10. A liquid discharge head according to claim 7, which further comprises a first common liquid chamber for storing a liquid to be supplied to said first flow path and a second common liquid chamber for storing a liquid to be supplied to said second flow path.

11. A liquid discharge head according to claim 10, wherein the liquid to be supplied to said first flow path and the liquid to be supplied to said second flow path are different liquids.

12. A liquid discharge head according to claim 11, wherein the liquid to be supplied to said second flow path excels the liquid to be supplied to said first flow path in at least one of the qualities, lowness of viscosity, bubble generating property, and thermal stability.

13. A liquid discharge head according to claim 7, wherein the leading terminal part of said movable separation membrane is disposed such that the position of the extension thereof lies above the lower part of said discharge port and apart from an orifice plate in which said discharge port is formed.

14. A liquid discharge head according to claim 7, wherein said movable member is provided in the proximity of the free end thereof with a lower displacement restraining part capable of enabling said movable member to assume a width greater than the width of said flow path.

15. A liquid discharge head according to claim 7, wherein said movable separation membrane is furnished with a slack part.

16. A liquid discharge head according to claim 7, wherein said movable member has said free end positioned on the discharge port side from the center of the area of said heating element.

17. A liquid discharge head according to claim 16, wherein said movable member is shaped like a plate.

18. A liquid discharge head according to claim 16, wherein said movable separation membrane is formed of resin.

19. A liquid discharge head according to claim 16, which further comprises a first common liquid chamber for storing a liquid to be supplied to said first flow path and a second common liquid chamber for storing a liquid to be supplied to said second flow path.

20. A liquid discharge head according to claim 19, wherein the liquid to be supplied to said first flow path and the liquid to be supplied to said second flow path are different liquids.

21. A liquid discharge head according to claim 16, wherein the leading terminal part of said movable separation membrane is disposed such that the position of the extension thereof lies above the lower part of said discharge port and apart from an orifice plate in which said discharge port is formed.

22. A liquid discharge head according to claim 16, wherein said movable member is provided in the proximity of the free end thereof with a lower displacement restraining part capable of enabling said movable member to assume a width greater than the width of said flow path.

23. A liquid discharge head according to claim 16, wherein said movable separation membrane is furnished with a slack part.

24. A liquid discharge head according to claim 6, wherein said movable member has said free end positioned on the discharge port side from the center of an area of said heating element.

25. A liquid discharge head according to claim 24, wherein said movable member is shaped like a plate.

26. A liquid discharge head according to claim 24, wherein said movable separation membrane is formed of resin.

27. A liquid discharge head according to claim 24, which further comprises a first common liquid chamber for storing a liquid to be supplied to said first flow path and a second common liquid chamber for storing a liquid to be supplied to said second flow path.

28. A liquid discharge head according to claim 27, wherein the liquid to be supplied to said first flow path and the liquid to be supplied to said second flow path are different liquids.

29. A liquid discharge head according to claim 28, wherein the liquid to be supplied to said second flow path excels the liquid to be supplied to said first flow path in at least one of the qualities, lowness of viscosity, bubble generating property, and thermal stability.

30. A liquid discharge head according to claim 24, wherein the leading terminal part of said movable separation membrane is disposed such that the position of the extension thereof lies above the lower part of said discharge port and apart from an orifice plate in which said discharge port is formed.

31. A liquid discharge head according to claim 24, wherein said movable member is provided in the proximity of the free end thereof with a lower displacement restraining part capable of enabling said movable member to assume a width greater than the width of said flow path.

32. A liquid discharge head according to claim 24, wherein said movable separation membrane is furnished with a slack part.

33. A liquid discharge head according to claim 6, wherein said movable separation membrane is formed of resin.

34. A liquid discharge head according to claim 6, which further comprises a first common liquid chamber for storing a liquid to be supplied to said first flow path and a second common liquid chamber for storing a liquid to be supplied to said second flow path.

35. A liquid discharge head according to claim 34, wherein the liquid to be supplied to said first flow path and the liquid to be supplied to said second flow path are different liquids.

36. A liquid discharge head according to claim 35, wherein the liquid to be supplied to said second flow path excels the liquid to be supplied to said first flow path in at least one of the qualities, lowness of viscosity, bubble generating property, and thermal stability.

37. A liquid discharge head according to claim 6, wherein the leading terminal part of said movable separation membrane is disposed such that the position of the extension thereof lies above the lower part of said discharge port and apart from an orifice plate in which said discharge port is formed.

38. A liquid discharge head according to claim 6, wherein said movable member is provided in the proximity of the free end thereof with a lower displacement restraining part capable of enabling said movable member to assume a width greater than the width of said flow path.

39. A liquid discharge head according to claim 6, wherein said movable separation membrane is furnished with a slack part.

40. A liquid discharge head according to claim 5, wherein said movable member is shaped like a plate.

41. A liquid discharge head according to claim 40, wherein said movable separation membrane is formed of resin.

42. A liquid discharge head according to claim 40, which further comprises a first common liquid chamber for storing a liquid to be supplied to said first flow path and a second common liquid chamber for storing a liquid to be supplied to said second flow path.

43. A liquid discharge head according to claim 42, wherein the liquid to be supplied to said first flow path and the liquid to be supplied to said second flow path are different liquids.

44. A liquid discharge head according to claim 43, wherein the liquid to be supplied to said second flow path excels the liquid to be supplied to said first flow path in at least one of the qualities, lowness of viscosity, bubble generating property, and thermal stability.

45. A liquid discharge head according to claim 40, wherein the leading terminal part of said movable separation membrane is disposed such that the position of the extension thereof lies above the lower part of said discharge port and apart from an orifice plate in which said discharge port is formed.

46. A liquid discharge head according to claim 40, wherein said movable member is provided in the proximity of the free end thereof with a lower displacement restraining part capable of enabling said movable member to assume a width greater than the width of said flow path.

47. A liquid discharge head according to claim 40, wherein said movable separation membrane is furnished with a slack part.

48. A liquid discharge head according to claim 5, wherein said movable separation membrane is formed of resin.

49. A liquid discharge head according to claim 48, which further comprises a first common liquid chamber for storing a liquid to be supplied to said first flow path and a second common liquid chamber for storing a liquid to be supplied to said second flow path.

50. A liquid discharge head according to claim 49, wherein the liquid to be supplied to said first flow path and the liquid to be supplied to said second flow path are different liquids.

51. A liquid discharge head according to claim 50, wherein the liquid to be supplied to said second flow path excels the liquid to be supplied to said first flow path in at least one of the qualities, lowness of viscosity, bubble generating property, and thermal stability.

52. A liquid discharge head according to claim 48, wherein the leading terminal part of said movable separation membrane is disposed such that the position of the extension thereof lies above the lower part of said discharge port and apart from an orifice plate in which said discharge port is formed.

53. A liquid discharge head according to claim 49, wherein said movable member is provided in the proximity of the free end thereof with a lower displacement restraining part capable of enabling said movable member to assume a width greater than the width of said flow path.

54. A liquid discharge head according to claim 48, wherein said movable separation membrane is furnished with a slack part.

55. A liquid discharge head according to claim 5, which further comprises a first common liquid chamber for storing a liquid to be supplied to said first flow path and a second common liquid chamber for storing a liquid to be supplied to said second flow path.

56. A liquid discharge head according to claim 55, wherein the liquid to be supplied to said first flow path and the liquid to be supplied to said second flow path are different liquids.

57. A liquid discharge head according to claim 56, wherein qualities of the liquid to be supplied to said second flow path exceeds those of the liquid to be supplied to said first flow path in at least one of the qualities, lowness of viscosity, bubble generating property, and thermal stability.

58. A liquid discharge head according to claim 57, wherein the leading terminal part of said movable separation membrane is disposed such that the position of the extension thereof lies above the lower part of said discharge port and apart from an orifice plate in which said discharge port is formed.

59. A liquid discharge head according to claim 57, wherein said movable member is provided in the proximity of the free end thereof with a lower displacement restraining part capable of enabling said movable member to assume a width greater than the width of said flow path.

60. A liquid discharge head according to claim 57, wherein said movable separation membrane is furnished with a slack part.

61. A liquid discharge head according to claim 56, wherein the leading terminal part of said movable separation membrane is disposed such that the position of the extension thereof lies above the lower part of said discharge port and apart from an orifice plate in which said discharge port is formed.

62. A liquid discharge head according to claim 56, wherein said movable member is provided in the proximity of the free end thereof with a lower displacement restraining part capable of enabling said movable member to assume a width greater than the width of said flow path.

63. A liquid discharge head according to claim 56, wherein said movable separation membrane is furnished with a slack part.

64. A liquid discharge head according to claim 55, wherein the liquid to be supplied to said first flow path and the liquid to be supplied to said second flow path are different liquids.

65. A liquid discharge head according to claim 64, wherein the liquid to be supplied to said second flow path excels the liquid to be supplied to said first flow path in at least one of the qualities, lowness of viscosity, bubble generating property, and thermal stability.

66. A liquid discharge head according to claim 55, wherein the leading terminal part of said movable separation membrane is disposed such that the position of the extension thereof lies above the lower part of said discharge port and apart from an orifice plate in which said discharge port is formed.

67. A liquid discharge head according to claim 55, wherein said movable member is provided in the proximity of the free end thereof with a lower displacement restraining part capable of enabling said movable member to assume a width greater than the width of said flow path.

68. A liquid discharge head according to claim 55, wherein said movable separation membrane is furnished with a slack part.

69. A liquid discharge head according to claim 5, wherein a leading terminal part of said movable separation membrane on the downstream side is disposed such that an extension thereof lies at a position above a lower part of said discharge port and apart from an orifice plate in which said discharge port is formed.

70. A liquid discharge head according to claim 69, wherein said movable member is provided in the proximity of the free end thereof with a lower displacement restraining part capable of enabling said movable member to assume a width greater than the width of said flow path.

71. A liquid discharge head according to claim 69, wherein said movable separation membrane is furnished with a slack part.

72. A liquid discharge head according to claim 5, wherein in proximity to the free end of said movable member, said movable member is provided with a lower displacement restraining part constructed to enable said movable member to assume a width greater than a width of said second flow path.

73. A liquid discharge head according to claim 72, wherein said movable separation membrane is furnished with a slack part.

74. A liquid discharge head according to claim 5, wherein said movable separation membrane is furnished with a slack part.

75. A liquid discharge head according to claim 6, wherein said movable member is shaped like a plate.

* * * * *

UNITED STATES PATENT AND TRADEMARK OFFICE

CERTIFICATE OF CORRECTION

PATENT NO. : 6,276,783 B1
DATED : August 21, 2001
INVENTOR(S) : Hiroyuki Ishinaga et al.

It is certified that error appears in the above-identified patent and that said Letters Patent is hereby corrected as shown below:

Column 5,
Line 45, change "liquid for" to -- liquid --.

Column 6,
Line 67, change "heat;" to -- head; --.

Column 7,
Line 2, change "devoid" to -- devoid of --;
Line 38, change "Embodiment" to -- Embodiments --; and
Line 40, change "ment" to -- ments --.

Column 13,
Line 2, change "path" to -- paths --.

Column 14,
Line 43, change "electrode" to -- electrodes --.

Column 15,
Line 23 and 25, change "electrode" to -- electrodes --; and
Line 52, change "movable 26" to -- movable member 26 --.

Column 17,
Line 60, change "parallelly" to -- parallel --.

Column 22,
Line 30, change "part" to -- parts --.

Column 25,
Line 13, change "membranes;" to -- membrane; --.

UNITED STATES PATENT AND TRADEMARK OFFICE

CERTIFICATE OF CORRECTION

PATENT NO. : 6,276,783 B1
DATED : August 21, 2001
INVENTOR(S) : Hiroyuki Ishinaga et al.

It is certified that error appears in the above-identified patent and that said Letters Patent is hereby corrected as shown below:

Column 29,
Line 5, change "claim 49" to -- claim 48 --.

Signed and Sealed this

Twenty-eighth Day of May, 2002

*Attest:*

*Attesting Officer*

JAMES E. ROGAN
*Director of the United States Patent and Trademark Office*